US005712623A

United States Patent [19]

Kumai et al.

[11] Patent Number: 5,712,623

[45] Date of Patent: Jan. 27, 1998

[54] SMALL-SIZED ALARM DEVICE

[75] Inventors: Hisao Kumai, Tokorozawa; Masazumi Niimi; Takashi Sano, both of Fussa, all of Japan

[73] Assignee: Casio Computer Co., Ltd., Tokyo, Japan

[21] Appl. No.: 550,362

[22] Filed: Oct. 30, 1995

[30] Foreign Application Priority Data

| | | | |
|---|---|---|---|
| Nov. 4, 1994 | [JP] | Japan | 6-270820 |
| Nov. 4, 1994 | [JP] | Japan | 6-270822 |
| Nov. 18, 1994 | [JP] | Japan | 6-285224 |

[51] Int. Cl.[6] ..... G08B 13/00

[52] U.S. Cl. ..... 340/565; 340/521; 340/552; 340/546; 340/566; 364/706; 364/708.1; 364/705.01

[58] Field of Search ..... 340/545, 522, 340/521, 546, 551, 552, 553, 554, 565, 566, 567, 562, 561; 364/706, 708.1, 705.01, 705.05

[56] References Cited

U.S. PATENT DOCUMENTS

| | | | |
|---|---|---|---|
| 3,623,063 | 11/1971 | Fontaine | 340/539 |
| 3,693,110 | 9/1972 | Briggs, Jr. et al. | 340/328 |
| 3,931,621 | 1/1976 | Rose | 340/328 |
| 4,011,554 | 3/1977 | Butler | 340/514 |
| 4,012,731 | 3/1977 | Solomon | 340/541 |
| 4,029,915 | 6/1977 | Ojima | 364/709.15 |
| 4,140,897 | 2/1979 | Guerra | 377/49 |
| 4,168,495 | 9/1979 | Sweeney | 340/546 |
| 4,173,755 | 11/1979 | Butler | 340/562 |
| 4,176,348 | 11/1979 | Tobin et al. | 340/562 |
| 4,213,035 | 7/1980 | Washizuka et al. | 364/562 |
| 4,287,513 | 9/1981 | Lam et al. | 340/562 |
| 4,325,058 | 4/1982 | Wagner et al. | 340/562 |
| 4,348,662 | 9/1982 | Fontaine et al. | 340/562 |
| 4,370,727 | 1/1983 | Bellet | 364/705.01 |
| 4,398,086 | 8/1983 | Smith, III | 235/145 R |
| 4,452,119 | 6/1984 | Tanimoto | 84/609 |
| 4,491,049 | 1/1985 | Mizuta et al. | 340/384.5 |
| 4,540,980 | 9/1985 | Porco | 340/586 |
| 4,604,610 | 8/1986 | Baker et al. | 340/566 |
| 4,611,200 | 9/1986 | Stilwell | 340/628 |
| 4,618,927 | 10/1986 | Hatta | 463/2 |
| 4,876,441 | 10/1989 | Hara et al. | 235/488 |
| 5,272,319 | 12/1993 | Rey | 235/379 |
| 5,309,145 | 5/1994 | Branch et al. | 340/540 |
| 5,321,390 | 6/1994 | Yuen | 340/566 |
| 5,371,694 | 12/1994 | Kawawaki et al. | 364/700 |
| 5,485,410 | 1/1996 | Mastromattei | 364/705.01 |

FOREIGN PATENT DOCUMENTS

| | | |
|---|---|---|
| 0385800 | 9/1990 | European Pat. Off. . |
| 93 02 873.3 | 6/1993 | Germany . |

*Primary Examiner*—Jeffery Hofsass
*Assistant Examiner*—Benjamin C. Lee
*Attorney, Agent, or Firm*—Frishauf, Holtz, Goodman, Langer & Chick

[57] ABSTRACT

A small-sized alarm device is hung on a doorknob to emit an alarm sound upon detecting that a human body contacts or approaches the doorknob. The alarm device has data processor, such as a calculator and the like, in addition to an alarm and an electro-optic display for displaying data processed by the data processor and information related to the operation of the alarm. To the alarm device is rotatably mounted a hanging member for hanging the alarm device on a doorknob. The hanging member is fit into the case of the alarm device when in not use or is erected from the case when the alarm device is hung on the doorknob.

28 Claims, 20 Drawing Sheets

NORMAL LOAD VIBRATION

SMALL-SIZED ALARM DEVICE

BACKGROUND OF THE INVENTION

1. Field of the Invention

The present invention relates to a small-sized alarm device which is activated when humans contact or approach.

2. Description of the Related

Small-sized alarm devices are known as described, for example, in U.S. Pat. Nos. 4,348,662 and 4,168,495, which are placed or hung on the doorknob of a room of a hotel during journey and are activated upon detecting that human bodies contact or approach the doorknob.

The conventional small-sized alarm devices are provided with only an alarm feature of producing alarm sounds upon detecting that human bodies contact or approach the doorknob.

For journey, it is desirable to carry as little baggage as possible in order to facilitate the management of baggage and reduce a danger of losing baggage. Thus, it is not appropriate to carry an alarm device only for the surveillance of doors at night.

In overseas travel the management of money is very important. General travelers are unfamiliar with the currencies of foreign countries where they are traveling and the fact is that many travelers have difficulty in imaging actual values of prices represented by unfamiliar currencies. For this reason, many travelers evaluate prices in foreign countries where they are traveling, such as hotel charges, by converting them into currencies of their own countries. For such travelers, a small electronic calculator that is handy to carry is now one of the necessities.

On the other hand, this means that two separate devices, a small electronic calculator and a small-sized alarm device, must be carried for traveling.

The small-sized alarm device needs a hanging member having a hole into which a doorknob is inserted and thus has to be made large to some extent, making it inconvenient to carry.

A large hanging member will protrude from the device body, resulting in poor portability.

In addition, when carried in a bag, it may catch on other things in the bag.

The conventional small-sized alarm devices only indicate their settings of whether or not they are placed in the ON state to produce an alarm and the volume of alarm sounds by the position of switches. Therefore, there arises a problem that the settings are difficult to confirm and are apt to be recognized erroneously.

The conventional small-sized alarm devices use a doorknob as a detecting electrode to detect variations in capacitance coupled with the doorknob due to the contact or approach of human bodies. Thus, the alarm devices cannot be used when the doorknob is not electrically conductive.

SUMMARY OF THE INVENTION

It is an object of the present invention to provide a small-sized alarm device which performs other functions necessary for travel other than an alarm function and is very handy to carry for travel.

It is another object of the present invention to provide a small-sized alarm device which permits various settings for the alarm function to be confirmed easily.

It is still another object of the present invention to provide a compact alarm device which has no protrusions and is good in safety and portability.

It is a further object of the present invention to provide a small-sized alarm device which is simple in construction and permits the detection of contact or approach of human bodies even if doorknobs are not electrically conductive.

According to the present invention, there is provided a small-sized alarm device comprising case means; alarm means, installed in the case means, for emitting an alarm sound upon detecting contact or approach of a human body; data processing means, installed in the case means, for processing data; and eletro-optic display means, mounted on the casing means, for displaying the data processed by the data processing means and information relating to the operation of the alarm means.

According to the present invention, a small-sized alarm device that alerts that a human body contacts or approaches comprises data processing means, such as a calculator and electro-optic display means for displaying data processed by the data processing means and relating to the operation of alarm means. Thus, the need of carrying another separate device such as a small calculator for traveling is eliminated, achieving a reduction in the amount of baggage. In addition, alarm feature-related information is displayed clearly, permitting easy confirmation.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of a small-sized alarm device according to the present invention will now be described with reference to the accompanying drawings.

(1) First Embodiment

Hereinafter, a first embodiment of the present invention will be described with reference to FIGS. 1 through 8.

Figure 1:
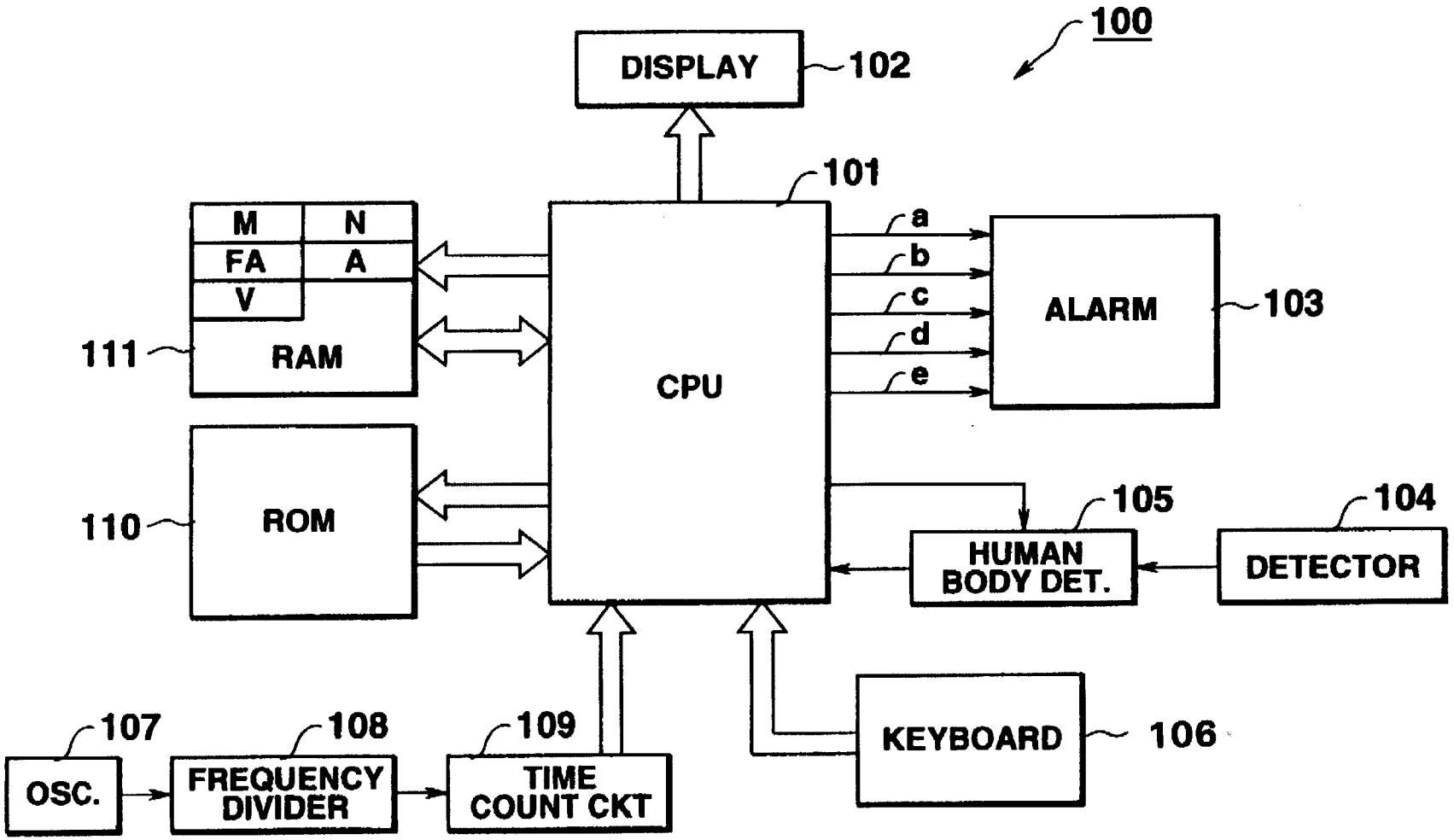
FIG. 1 is a circuit block diagram of a small-sized alarm device according to a first embodiment of the present invention.

FIG. 1 is a circuit block diagram of a small-sized alarm device 100 to which the present invention is applied. The alarm device 100 of the first embodiment has a doorknob alarm mode of watching the intrusion by others through a door or the like as an additional mode in addition to a normal mode.

The normal mode includes a CAL (CALCULATOR) mode in which various calculations including currency conversion can be performed, a timekeeping mode in which time is displayed, an alarm mode in which the alarm sounds at a set time, and a simplified buzzer mode in which a sound of great volume is produced immediately.

As shown in FIG. 1, the alarm device is constructed from a CPU (Central Processing Unit) 101 which controls the entire device, a display section 102 comprising an LCD (Liquid Crystal Display), an alarm section 103 which produces an alarm sound as instructed by the CPU 101, a detector section 104 which is made of an electrically conductive material and used to hang up the device body on a doorknob for use, a human body detector 105 which detects human bodies contacting or approaching the doorknob and vibrations, a keyboard section 106 having various keys as will be described later, an oscillator circuit 107 for producing a clock signal of a preset frequency, a frequency divider circuit 108 which divides the frequency of the clock signal by a predetermined number, a time counting circuit 109 which counts clock pulses from the frequency divider 108 to thereby perform a time count operation, a ROM (Read Only Memory) 110 which stores various control programs and the like, and a RAM (Random Access Memory) 111 which has various internal registers and is mainly used as a work area.

Figure 2:
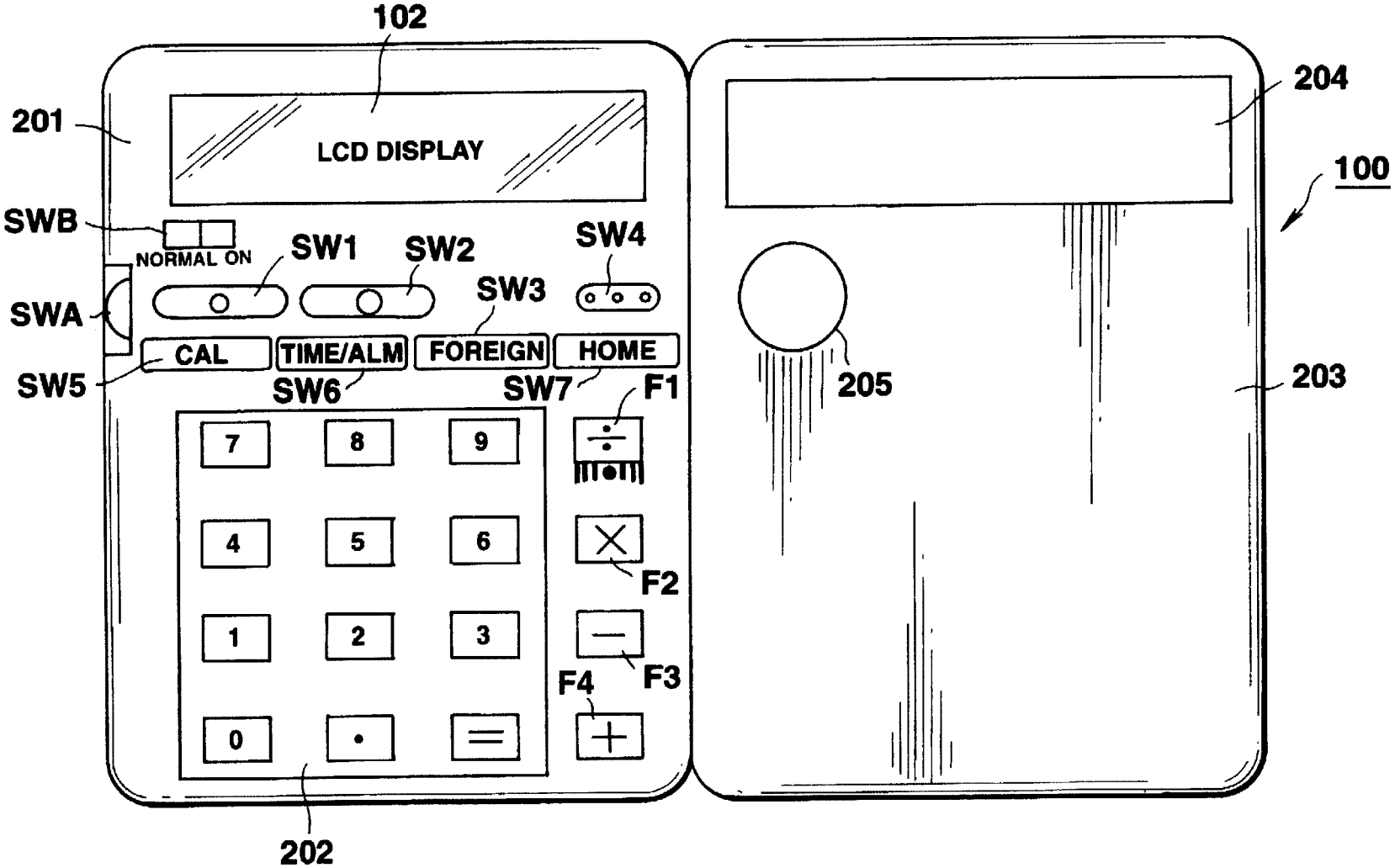
FIG. 2 is an exterior view of the alarm device of FIG. 1.

FIG. 2 is an exterior view of the alarm device 100. As shown, on a case 201 there are provided a numeric keypad 202 including a decimal point key and an equal key, a volume SWA for setting the sensor sensitivity to human bodies, a slide switch SWB for switching between the normal mode and the doorknob alarm mode, keys SW1 and SW2 for setting the volume of alarm sound, a FOREIGN key SW3 which, in the doorknob alarm mode, permits a sound of great volume to be stopped and, in the CAL mode, permits currency conversion between two countries, a key SW4 which starts an alarm at great volume immediately, a CAL key SW5 for setting the CAL mode, a TIME/ALM key SW6 which switches between the timekeeping mode and the alarm mode, a HOME key SW7 which permits currency conversion between two countries preset in the CAL mode, and F1 through F4 keys which function as arithmetic function keys in the CAL mode.

On an edge portion of the case 201 is mounted openably a cover 203, which has openings 204 and 205 and entirely covers the case 201 when closed.

Figure 3:
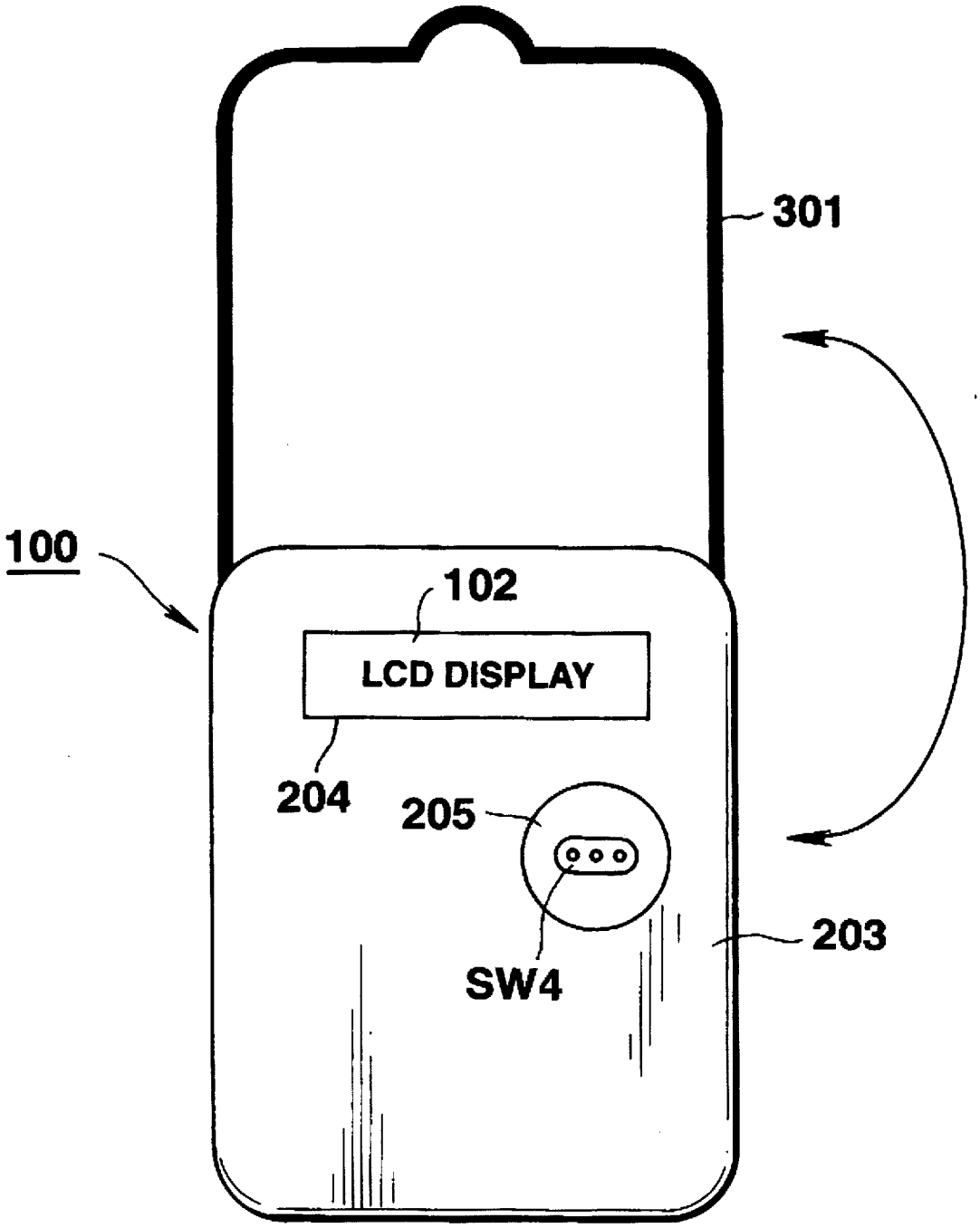
FIG. 3 is an exterior view of the alarm device of FIG. 2 with its cover closed.

FIG. 3 is an exterior view of the alarm device 100 with its cover 203 closed. As shown, with the cover 203 closed, the display section 102 shows from the opening 204 and the key SW4 shows from the opening 205. In this state, therefore, only the key SW4 can be operated to start the emission of a sound of great volume in the simplified alarm buzzer mode, but the FOREIGN key SW3 cannot be operated because of the presence of the cover 203. Thus, once the burglar buzzer sounds, others than the user cannot stop it easily. In addition, in order to sound the burglar buzzer, the key SW4 must be operated through the opening 205 in the cover 203, which will reduce the possibility of sounding the buzzer by mistake in any normal mode.

A hook 301 is made of an electrically conductive material and serves as a member for hanging the alarm device 100 on a doorknob. The hook 301 corresponds to the detector 104 of FIG. 1. That is, the hook 301 is used not only as a member for hanging the alarm body on a doorknob but also as a probe for detecting human bodies contacting or approaching the doorknob.

The hook 301 is provided, as shown in FIG. 3, with a convex portion at its top, which will help hang the alarm device on a doorknob stably.

In addition, though not shown, the hook 301 is pivotally mounted to the upper portion of the case 201 so that it can be fit into the rear side of the case when not in use. This will prevent the alarm device from becoming bulky, improving its portability.

An outline of the operation of the alarm thus constructed will be described with reference to FIGS. 4, 5 and 6.

As described previously, the alarm device 100 has two types of modes: the normal mode and the doorknob alarm mode (additional mode) in which the alarm sounds upon detecting human bodies. The normal mode is classified into the timekeeping mode, the CAL mode, and the time alarm mode.

Figure 4:
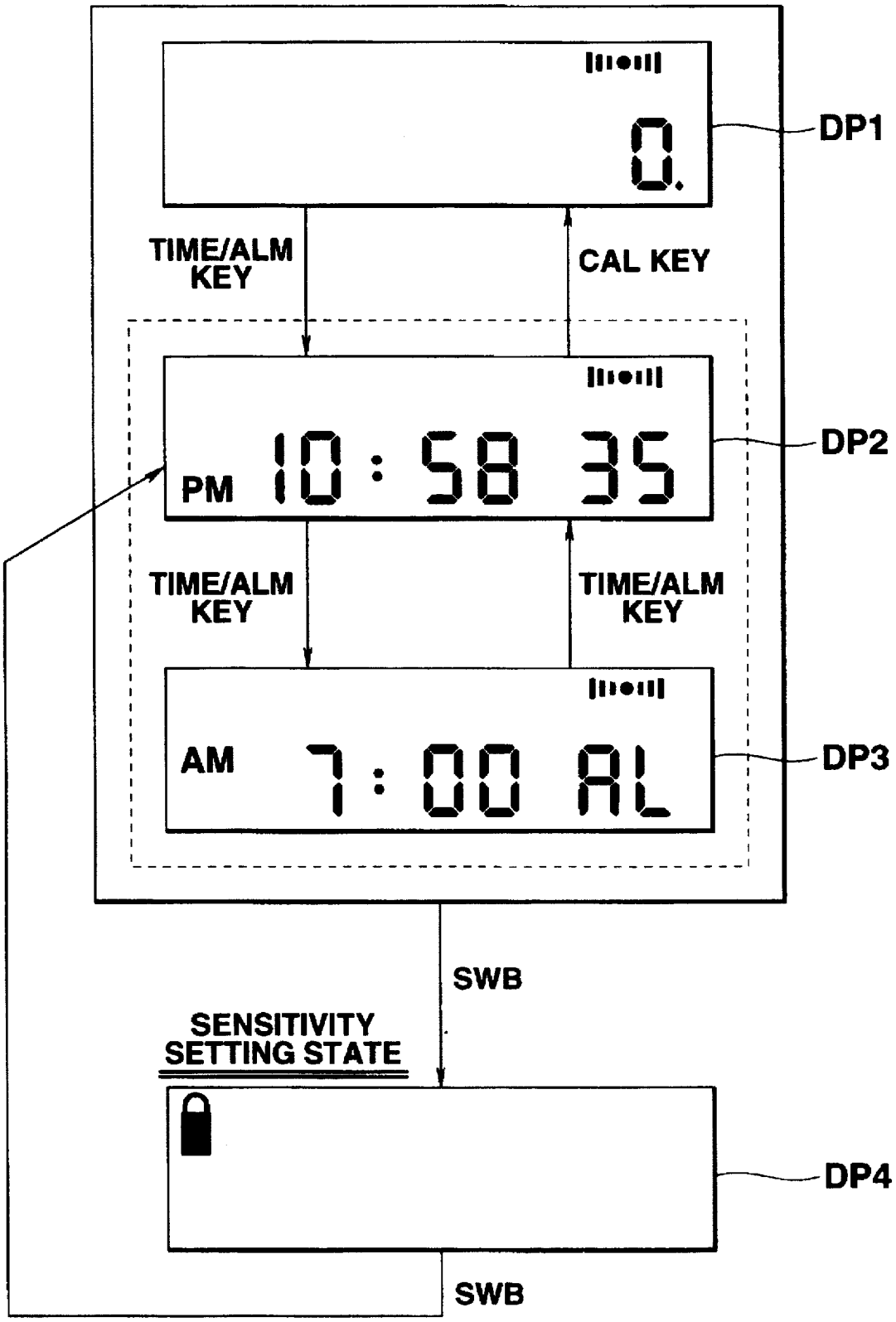
FIG. 4 is a diagram for use in explanation of relationships among various key operations and modes set by the key operations in the alarm device of FIG. 1.

FIG. 4 is a diagram for use in explanation of relationships of various key operations to resulting modes. In FIG. 4, DP1, DP2, DP3 and DP4 each show an exemplary display on the display section 102 in the CAL mode, in the timekeeping mode, in the time alarm mode, and in the doorknob alarm mode, respectively.

The timekeeping mode and the time alarm mode are set such that a change is made from the timekeeping mode to the time alarm mode or from the time alarm mode to the timekeeping mode each time the TIME/ALM key SW6 is operated.

The time alarm mode is a mode to set the alarm to sound and set a time when the alarm sounds. In the present embodiment, the time setting is made by operating the numeric keypad 202 and the setting of the alarm to sound is made by operating the F1 key. In the display example of DP3, a picture displayed at the upper right informs the user of the alarm having been set to sound. This picture will disappear by operating the F1 key a second time. In this example, the alarm is set for 7 a.m.

When the CAL key SW5 is operated in the timekeeping mode or the time alarm mode, switching is made to the CAL mode as indicated by DP1 in FIG. 4. In the CAL mode, the CPU 101 performs computational processing according to user's operations on the numeric keypad 202 and the F1 to F4 keys and displays the results on the display section 102.

In the CAL mode, after the entry of numeric data from the numeric keypad, when the FOREIGN key SW5 is operated, that numeric data is multiplied by predetermined numeric data entered beforehand, or when the HOME key SW7 is operated, that numeric data is divided by this predetermined numeric data, whereby currency conversion between two countries is permitted. For example, assuming that 97 has been entered beforehand for the conversion rate of ¥(yen) to $(dollar), when the FOREIGN key SW5 is operated after the entry of numeric data in dollars, numeric data will be displayed converted into yen. On the other hand, when the HOME key SW7 is operated after the entry of numeric data in yen, numeric data will be displayed converted into dollars.

In the normal mode, when the slide switch SWB is slid from the "normal" position to the "ON" position, switching is made from the normal mode to the doorknob alarm mode. At this time, the CPU 101 displays a picture (doorknob alarm picture) that informs the user of the doorknob alarm mode having been set, at the upper left of the display section as shown in the display example DP4.

Figure 5:
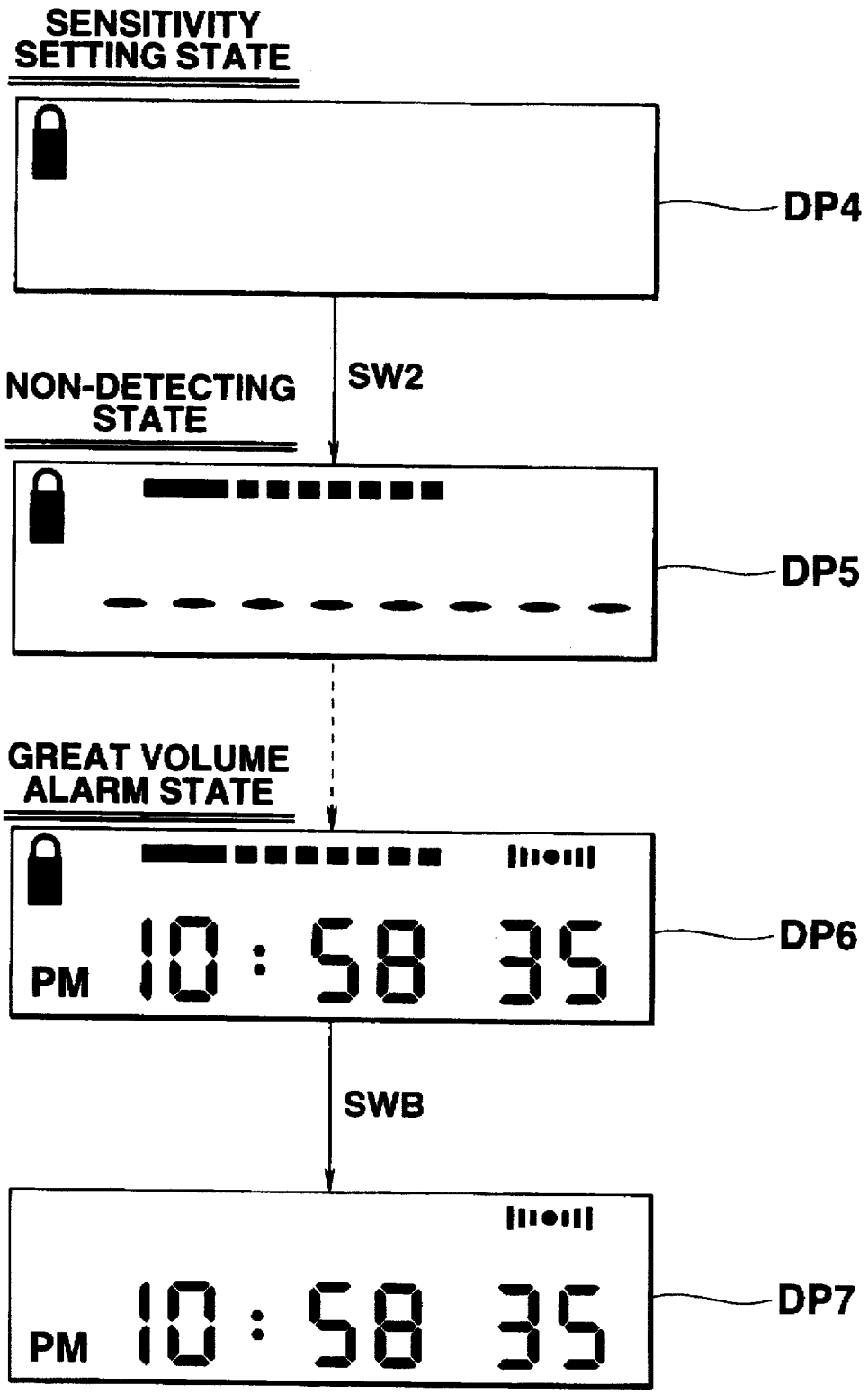
FIG. 5 is a diagram for use in explanation of state transitions when the alarm device of FIG. 1 is set to a doorknob alarm mode.

FIG. 5 is a diagram for use in explanation of state transitions in the doorknob alarm mode.

In the present embodiment, the alarm is placed in the sensitivity setting state immediately after the doorknob alarm mode has been set, in which state only the doorknob alarm picture is displayed as in the display example DP4. The sensitivity setting is performed to adjust the sensor sensitivity properly and verify the operation under the sensitivity because electrical properties and vibration characteristics of doors and doorknobs vary from type to type. The volume SWA of FIG. 2, used to adjust the sensor sensitivity, increases the sensitivity when turned clockwise and decreases the sensitivity when turned counterclockwise.

Upon detecting that the volume SWA has been operated by the user, the CPU 101 sets the resistance of the human body detector circuit 105 to a new value accordingly. When the user sets an alarm sound volume by operating the key SW1 or SW2, i.e., enters data related to alarm after the termination of the sensitivity setting, the CPU 101 makes a transition from the sensitivity setting state to a non-detecting state in which no human body detecting operation is performed for a predetermined period of time. DP5 indicates a display example in the non-detecting state. In this display example DP5, the length of bars displayed in line at the top represents the sound volume set (in this example, the volume is set great), and a total of eight segments displayed in line below the bars represents the duration of the non-detecting state that begins now.

Figure 6:
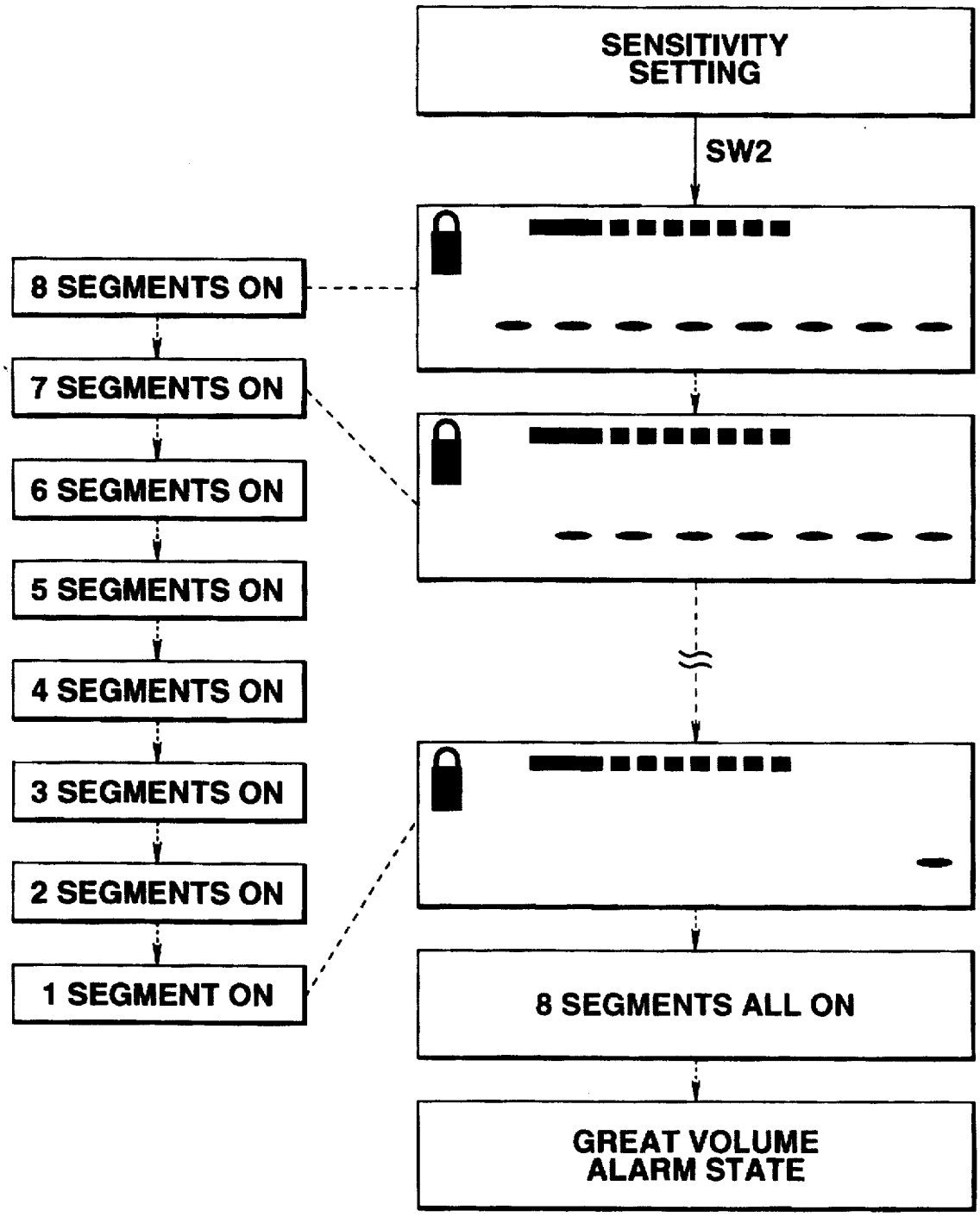
FIG. 6 is a diagram for use in explanation of segment display state transitions in the non-detecting state of the alarm device of FIG. 1.

FIG. 6 is a diagram for use in explanation of display state transitions of the segments representing the remainder of the duration of the non-detect state.

As shown in FIG. 6, when the transition from the sensitivity setting state from the non-detecting state occurs as a result of the operation of the key SW2, the eight segments, which are all turned on at first, are turned off in sequence with time. When all the segments are turned off, the transition is made from the non-detecting state from the detecting state in which the alarm sounds when detecting a human body. In the present embodiment, the interval between the time that each segment is turned off and the time that the next segment is turned off is set to two seconds. Thus, the CPU 101 turns one segment off every two seconds after the transition to the non-detecting state and makes the transition from the non-detecting state to the detecting state when 16 seconds elapse from the transition to the non-detecting state.

Upon entering the detecting state, the CPU 101 changes the display from the display example DP5 of FIG. 5 to the display example DP6, so that the current time is displayed. In the display example DP6 shown in FIG. 6, the time alarm picture is displayed, indicating that the time alarm mode has been already set before the doorknob alarm mode is set.

Thus, according to the first embodiment, alarm-related settings including the burglar alarm sound volume and whether the doorknob alarm mode is set or not are displayed on the display section 102, which helps the user know them easily.

Moreover, the first embodiment is designed to enter the non-detecting state prior to the detecting state so as to disable the alarm from emitting a sound before the user hangs the alarm on a doorknob and leaves it, preventing unwanted alarm sound from displeasing others. Furthermore, since the remainder of the duration of the non-detecting state is displayed in the user understandable form, the user can afford to hang the alarm on a doorknob.

Once the doorknob alarm mode is set, it is canceled by sliding the slide switch SWB from the ON to the NORMAL position, switching into the timekeeping mode. When the slide switch SWB is placed to the NORMAL position, the CPU 101 changes the display from DP6 to DP7.

Upon detecting the operation of the key SW4, the CPU 101 immediately provides to the alarm section 103 a great-volume alarm sound emission start signal "b". The alarm section 103 is equipped, though not shown in particular, with a control circuit, an amplifier, a loudspeaker and so on and immediately starts the emission of an alarm sound of great volume upon receipt of that signal "b" from the CPU 101. This emission of alarm sound is continued until receipt of an alarm sound stop signal "e" from the CPU 101.

The small-sized alarm device 100 according to the first embodiment, which is powered by batteries, has an alarm sound demonstration feature for battery checking. With this feature, when the key SW1 or SW2 is operated in a mode other than the doorknob alarm mode, the CPU 101 causes an alarm sound to be emitted at a volume assigned to the key while it is being operated.

Figure 7:
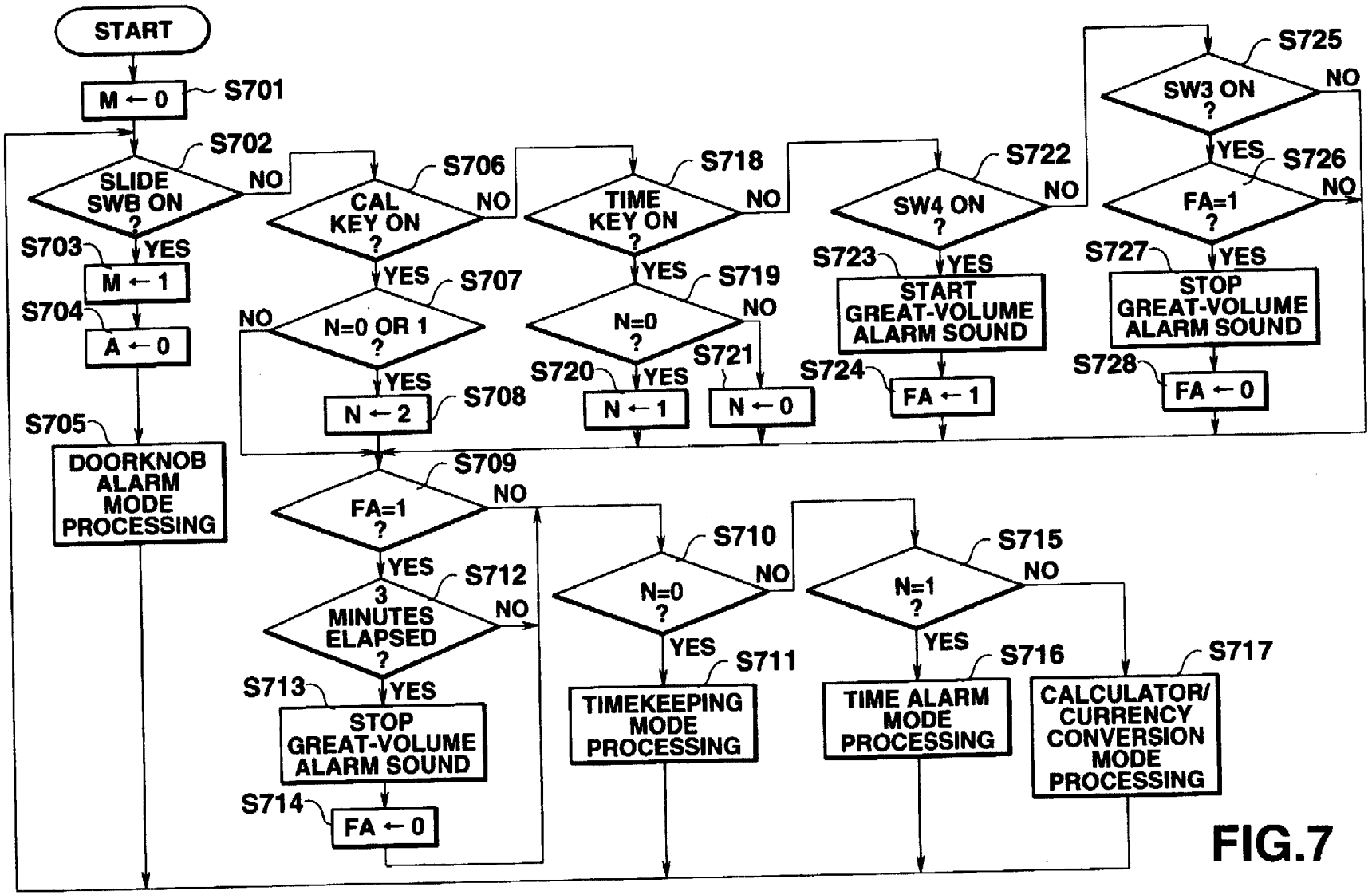
FIG. 7 is a flowchart illustrating the overall processing by the alarm device of FIG. 1.
Figure 8:
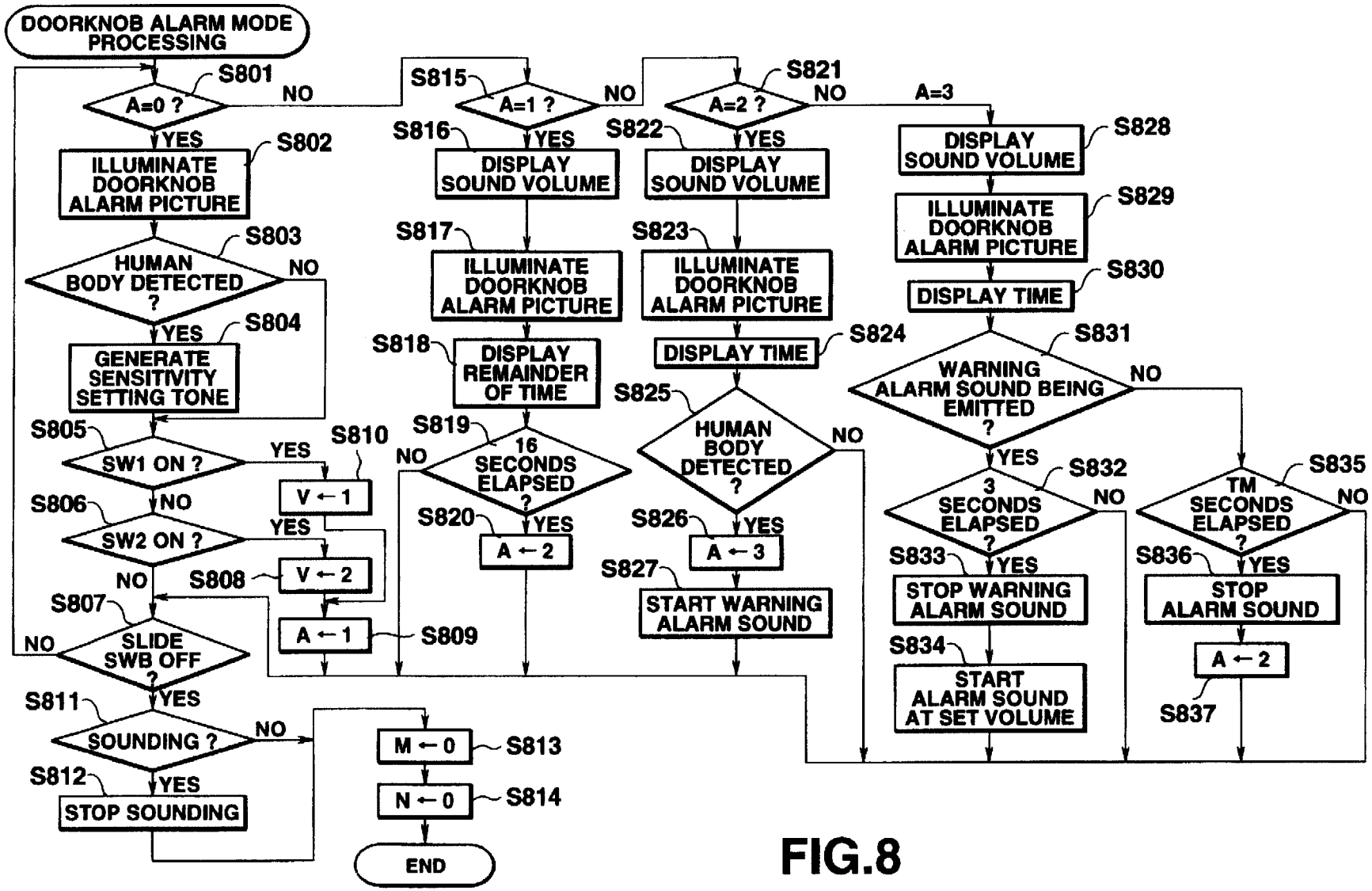
FIG. 8 is a flowchart for the doorknob alarm mode processing in FIG. 7.

Reference is now made to FIGS. 7 and 8 to describe the operation of the alarm device specifically.

FIG. 7 is a flowchart illustrating the overall processing operation of the small-sized alarm device of the present embodiment. Note here that M, N, A and FA denote internal registers of the RAM 111. The M register stores a numeric value for the doorknob alarm mode or the normal mode. The N register specifies the timekeeping mode, the time alarm mode, and the CAL mode in the normal mode for N=0, N=1, and N=2, respectively. The A register specifies the sensitivity setting state, the non-detecting state, the human body detecting state, and the alarm sound emitting state in the doorknob alarm mode for A=0, A=1, A=2, and A=3, respectively. The FA register stores a value representing whether the burglar buzzer is sounding or not.

First, the CPU 101 sets a 0 into the M register to initialize the normal mode (S701). Next, a determination is made as to whether or not the slide switch SWB is turned ON, i.e., whether or not the switch SWB is placed to the ON position (S702). If the determination is that the switch SWB is placed to the ON position, then a 1 is set in the M register to set the doorknob alarm mode (S703). Then, a 0 is set into the A register to set the sensitivity setting state (S704), a doorknob alarm process which will be detailed later is carried out (S705), and the process returns to step S702.

If, in step S702, the determination is that the slide switch SWB is not set to the ON position, in other words, the switch is set to the NORMAL position, then a determination is made as to whether or not the CAL key SW5 has been pressed (S706). If the determination is that the CAL key has been pressed, then a determination is made as to whether the N register value is 0 or 1, i.e., whether the time alarm mode or the timekeeping mode is now set (S707). If the N register value is either 0 or 1, then 2 is set into the N register to switch into the CAL mode (S708). Then, the process goes to step S709. If, on the other hand, the determination in block S707 is that the N register value is neither 0 nor 1, then the process goes to step S709.

In step S709, a determination is made as to whether the FA register value is 1 or not, i.e., whether the burglar buzzer is now sounding or not. If the FA register value is not 1, then a determination is made as to whether or not the N register value is 0, i.e., whether or not the timekeeping mode is now set (S710). If N=0, i.e., the timekeeping mode is now set, then a timekeeping mode process is carried out to read the current time from an internal register in the RAM 111 for display on the display section 102 (S711). Then, the process returns to step S702.

If the determination in step S709 is that the FA register value is 1, i.e., the burglar buzzer is now sounding, then a determination is made as to whether or not three minutes have elapsed from the time that the buzzer began to sound (S712). If three minutes have not elapsed, then the process goes to step S710. If, on the other hand, three minutes have elapsed, then an alarm sound stop signal "e" is sent to the alarm section 103, thereby stopping an alarm sound of great volume (S713). Then, a 0 is set into the FA register (S714), and the process goes to step S710.

If, in step S710, the determination is that the N register value is not 0 (timekeeping mode), then a determination is made as to whether or not the N register value is 1 (time alarm mode) (S715). When the N register value is 1, a time alarm mode process is carried out to set the time at which the alarm is to sound (S716). Then, the process returns to step S702.

If, in step S715, the determination is that the N register value is not 1, in other words, that the CAL mode is set (N=2), then a calculator mode process including currency conversion is carried out in accordance with operations of the numeric keypad 202, F1 to F4 keys, FOREIGN key SW3, and HOME key SW7 (S717). Then, the process returns to step S702.

When the time alarm is set to the ON state, the time alarm mode process is carried out in step S716, thereby executing a coincidence detecting process of detecting whether the current time has reached the preset alarm time in each of the doorknob alarm mode process in step S705, the timekeeping mode process in step S711, and the calculator mode process in step S717 as well as the time alarm mode process. When a coincidence is detected, an alarm generation process is carried out to emit an alarm sound.

If, on the other hand, the determination in step S706 is that the CAL key SW5 has not been pressed, then a determination is made as to whether or not the TIME/ALM key SW6 has been operated (S718). If the determination is that the TIME/ALM key SW6 has operated, then a determination is made as to whether or not the N register value is 0, i.e., whether or not the timekeeping mode is now set (S719).

When the N register value is 0, a 1 is set into the N register to switch into the time alarm mode (S720). Then, the process goes to step S709.

If the N register value is not 0 in step S719, this corresponds to the case where the TIME/ALM key SW6 has been operated in the time alarm mode in which the N register value is 1 or the CAL mode in which N=2. In this case, a 0 is set into the N register to switch into the timekeeping mode (S721). Then, the process goes to step S709.

If, in step S718, the determination is that the TIME/ALM key SW6 has not been operated, then a determination is made as to whether or not the key SW4 has been operated (S722). If the determination is that the key SW4 has been operated, then the great-volume alarm sound generation start signal "b" is sent to the alarm section 103, thereby starting to emit an alarm sound of great volume (S723). Then, a 1 is set into the FA register to thereby store that an alarm sound of great volume is being emitted (S724). After that, the process goes to step S709.

If, in step S722, the determination is that the key SW4 has not been operated, then a determination is made as to whether or not the FOREIGN key SW3 has been operated (S725). If the FOREIGN key SW3 has been operated, then a determination is made as to whether or not the FA register value is 1, i.e., whether or not an alarm sound of great volume is now being emitted (S726).

If the FA register value is not 1, then the alarm section 103 is supplied with the alarm sound stop signal "e" to stop emitting alarm sound of great volume (S727). Then, a 0 is set into the FA register (S728), and the process goes to step S709.

If, in step S725, the determination is that the FOREIGN key SW3 has not been operated, or if, in step S726, the determination is that the FA value is not 1, then the process goes to step S709.

Thus, the present embodiment permits mode setting and switching based on various key operations, allowing the user to optionally set a desired mode. In addition, when the key SW4 is operated, the burglar buzzer is permitted to sound at great volume regardless of what mode is presently set. In case of emergency, therefore, the user simply operates the key SW4 and the alarm sounds immediately.

Next, the doorknob alarm mode process in step S705 (refer to FIG. 5) will be described in detail. FIG. 8 is a flowchart for the doorknob alarm mode process.

In this doorknob alarm mode process, a determination is first made as to whether or not the A register value is 0, i.e., whether or not the mode is set in the sensitivity setting state (S801). If the A register value is 0, then the doorknob alarm picture is illuminated as shown in FIG. 5 (step S802). Next, a determination is made as to whether or not a human body has been detected (S803). If the determination is that a human body has been detected, then a sensitivity setting tone one-time producing signal "a" is provided to the alarm section 103, which then produces a sensitivity setting tone once (S804). Then, the process goes to step S805. If the determination is that no human body has been detected, then the process goes to step S805.

As described previously, the material of a door and/or doorknob varies with hotels, which requires an adjustment of the sensor sensitivity to a value suitable for the detection of human bodies. The present embodiment allows the sensor sensitivity adjustment to be made in the sensitivity setting state and informs the user of the current sensor sensitivity by emitting an alarm sound once upon detecting a human body. This permits an easy, accurate adjustment of the sensor sensitivity.

In step S805, a determination is made as to whether or not the key SW1 has been operated, in other words, whether or not the user has specified an alarm sound of small volume. If the determination is that the key SW1 has not been operated, then a determination is made as to whether or not the key SW2 has been operated, in other words, whether or not the user has specified an alarm sound of great volume (S806). If the key SW2 has not been operated, then a determination is made as to whether or not the slide switch SWB is turned OFF, i.e., whether or not the slide switch SWB is set to the NORMAL position (S807). If the switch SWB is not turned OFF, then the process returns to step S801.

If, in step S805, the determination is that the key SW1 has been operated, then a 1 indicating small volume is set into the V register that stores a value indicating the volume of an alarm sound (S810), and then a 1 indicating the non-detecting state is set into the A register (S809). After that, the process goes to step S807. If, in step S806, the determination is that the key SW2 has been turned on, then a 2 indicating great volume is set into the V register (S808), and then a 1 indicating the non-detecting state is set into the A register (S809). After that, the process goes to step S807.

Though not shown, during the interval from step S801 to step S807, that is, during the interval when the A register value=0, a process of detecting a user's operation on the volume SWA and varying the sensor sensitivity accordingly is performed. When the sensitivity setting state continues for a preset period of time (about 10 minutes in the present embodiment), a process of automatically making transition to the non-detecting state is performed. In this state, the last settings are applied for the volume and sensor sensitivity.

If, in step S807, the determination is that the slide switch SWB is set to the NORMAL position (OFF position), that is, the doorknob alarm mode is canceled, then a determination is made as to whether or not the alarm is now sounding (S811). If the determination is that the alarm is now sounding, then an alarm sound stop signal "e" is applied to the alarm section 103 to stop emitting the alarm sound (S812), a 0 is set into the M register (S813), and a 0 is set into the N register (S814), whereby a sequence of processes is terminated. If, in step S811, the determination is that the alarm is not now sounding, then the process goes to step S813.

If, in step S801, the A register value is not 0, then a determination is made as to whether or not the A register value is 1, or the non-detecting state is now set (S815). If the A register value is 1, then the sound volume specified by the key SW1 or SW2 is displayed on the display section 102 (S816), the doorknob alarm picture is illuminated (S817), and the time left for the transition from the non-detecting state to the detecting state is displayed (S818).

A determination is next made as to whether or not 16 seconds have elapsed from the transition to the non-detecting state (S819). If 16 seconds have not elapsed, then the process goes to step S807. Conversely, if 16 seconds have elapsed, then 2 is set into the A register to switch into the detecting state (S820), and the process then goes to step S807.

In the present embodiment, as described previously, a transition is automatically made from the non-detecting state to the detecting state after a lapse of 16 seconds from the transition to the non-detecting state. The remainder of the time set for the non-detecting state can be known through the segments which are turned off one by one every two seconds as shown in FIG. 2, allowing the user to perform the setting work easily.

If, in step S815, the determination is that the A register value is not 1, then a determination is made as to whether or not the A register value is 2, that is, whether or not the detecting state is set (S821). If the A register value is 2, then a set sound volume is displayed on the display section 102 (S822), the doorknob alarm picture is illuminated, and the current time is displayed on the display section (S824).

After the display of the current time, a determination is next made as to whether or not a human body has been detected (S825). If the determination is that a human body has been detected, then 3 is set into the A register (S826), and a warning alarm sound emission start signal "d" is sent to the alarm section 103 to start emission of a warning alarm sound (S827). The process then goes to step S807. If the determination is that no human body has been detected, then the process immediately goes to step S807.

If, in step S821, the determination is that the A register value is not 2, that is, when the alarm sound is being emitted (A=3), then the set sound volume is displayed on the display section (S828), the doorknob alarm picture is illuminated (S829), and the current time is displayed on the display section (S830).

Next, a determination is made as to whether or not a warning alarm sound is being emitted (S831). If the warning alarm sound is being emitted, then a determination is made as to whether or not three seconds have elapsed from the start of emission of the warning alarm sound (S832). If three seconds have elapsed, then an alarm sound stop signal "e" is applied to the alarm section 103 to stop the emission of the warning alarm sound (S833). After that, either a great-volume alarm sound emission start signal "b" or a small-volume alarm sound emission start signal "e", which depends on the volume setting, is sent to the alarm section 103, thereby starting the emission of an alarm sound at a set volume (S834). Then, the process goes to step S807. If, in step S832, the determination is that three seconds have not elapsed yet, then the process immediately goes to step S807.

Note here that the warning alarm sound refers to an alarm sound of a small volume which is emitted three seconds prior to the emission of an alarm sound and set much smaller than the smallest alarm sound that can be set by the user. The user can recognize by the warning alarm sound that an alarm sound of greater volume is to be emitted. In the event that the user touches the alarm by mistake or a malfunction occurs, therefore, the user is allowed to take effective measures against such a situation before the greater-volume alarm sound is emitted to thereby avoid a trouble to others in the vicinity of the user in a hotel or the like.

If, in step S831, the determination is that a warning alarm sound is not being emitted, that is, an alarm sound is being emitted at a set volume, then a determination is made as to whether or not TM seconds, a preset time, have elapsed from the start of emission of the alarm sound (S835). If the determination is that TM seconds have not elapsed, then the process goes to step S807. If the determination is otherwise, then an alarm sound stop signal "e" is sent to the alarm section 103 to stop the emission of the alarm sound (S836) and 2 is set into the A register to make transition to the detecting state (S837). After that, the process goes to step S807.

Thus, if the doorknob alarm mode is set, the doorknob alarm picture, the set volume of an alarm sound, and the remainder of the time taken to make transition from the non-detecting state to the detecting state are displayed on the display section 102. This enables the user to confirm the current settings easily. In addition, the remainder of the time can be recognized, allowing the user to perform the setting operation easily.

As described above, the small-sized alarm device 100 of the present embodiment has a calculator feature and a timekeeping feature in addition to a doorknob alarm feature. For this reason, the alarm of the present embodiment eliminates the need of carrying both of a small calculator and a small-sized alarm in traveling, thereby improving handiness and decreasing the amount of baggage.

In the timekeeping mode of the present embodiment, only one time is displayed. Alternatively, the alarm device may be designed so that the local time of each of countries in which the user travels can be displayed. Moreover, the alarm device may be provided with various features including a stopwatch feature, a timer feature and the like. Furthermore, the alarm device may be designed so that it can be used not only as a watch and a calculator but as a portable radio as well.

As described above, the small-sized alarm device of the first embodiment, which comprises an alarm feature in addition to a calculator feature, eliminates the need for the user to carry two separate devices of a small calculator and a small-sized alarm device, decreasing the amount of baggage and improving handiness.

Moreover, the hanging member of the alarm device is rotatably mounted to the device body so that it can be fit into the body when not in use. Thus, the alarm body can be made compact when the alarm feature is not used, improving its portability.

Furthermore, alarm related data (settings), such as alarm setting, alarm sound volume and the like, is displayed on the display section, which allows the user to know various settings easily.

In addition, the alarm device comprises a timekeeping feature in addition to the calculator feature and the alarm feature, achieving a further improvement in handiness.

Other embodiments of the small-sized alarm device according to the present invention will be described. The same portions as those of the first embodiment will be indicated in the same reference numerals and their detailed description will be omitted.

(2) Second Embodiment

Figure 9:
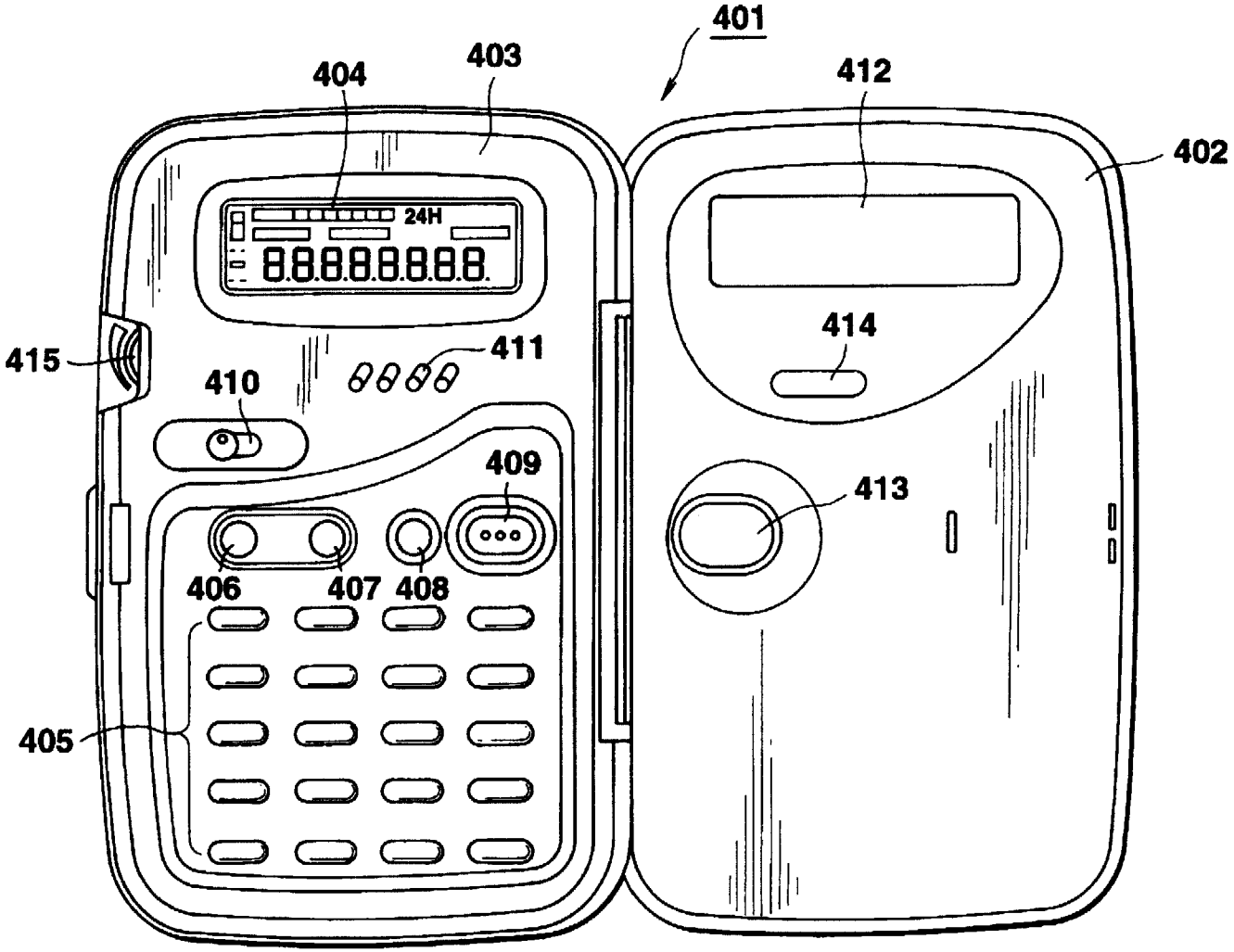
FIG. 9 is a plan view of a small-sized alarm device according to a second embodiment of the present invention.

Hereinafter, a second embodiment of the present invention will be described with reference to FIGS. 9 to 14. FIG. 9 is an front view of a small-sized alarm device 401 according to the second embodiment with its cover 402 open.

The alarm device 401 comprises a case 403 and the cover 402 which is openably mounted to the case on its right side. Besides a doorknob alarm feature, the alarm has a timekeeping feature, a calculator feature, and an alarm feature in which an alarm sound is emitted when a specific key is pressed. Normally, the current time is displayed on a liquid crystal display section 404.

As shown, on the front of the alarm case 403 there is provided the liquid crystal display section 404 tot its top. Below the display section 404, there are provided a numeric keypad 405, a doorknob alarm ON key 406 for setting the doorknob alarm feature to the ON state, a doorknob alarm OFF key 407 for setting the doorknob alarm feature to the OFF state, a sound volume setting key 408 for setting the volume of an alarm sound, an alarm sound emission key 409 which is operated to emit an alarm sound, and a slide type power switch 410 for turning the power of the alarm device 401 ON or OFF. Between the display section 404 and the keys, there is provided a buzzer 411 for emitting an alarm sound.

The cover 402 comprises a display window 412 which, with the cover closed, allows the user to view the display contents of the display section 404. The cover 402 is further provided with an opening 413 which allows the user to operate the alarm sound emission key 409 with the cover closed and an opening 414 which permits a sound emitted by the buzzer 411 to carry to outside.

On the left side of the case, there is provided a volume 415 for adjusting the human body detecting sensitivity.

Figure 10C:
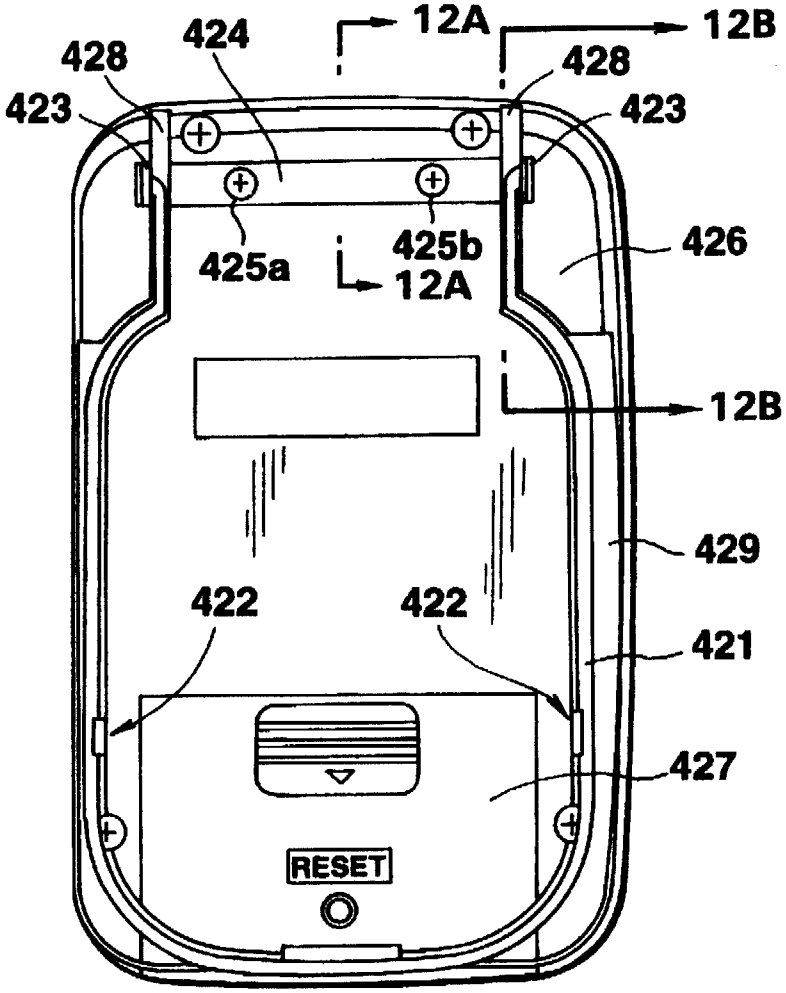
FIG. 10C is a rear plan view of the alarm device of FIG. 10A.
Figure 10B:
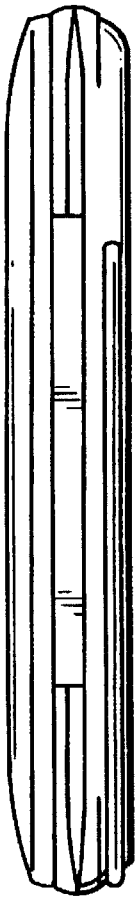
FIG. 10B is a right side view of the alarm device of FIG. 10A.
Figure 10A:
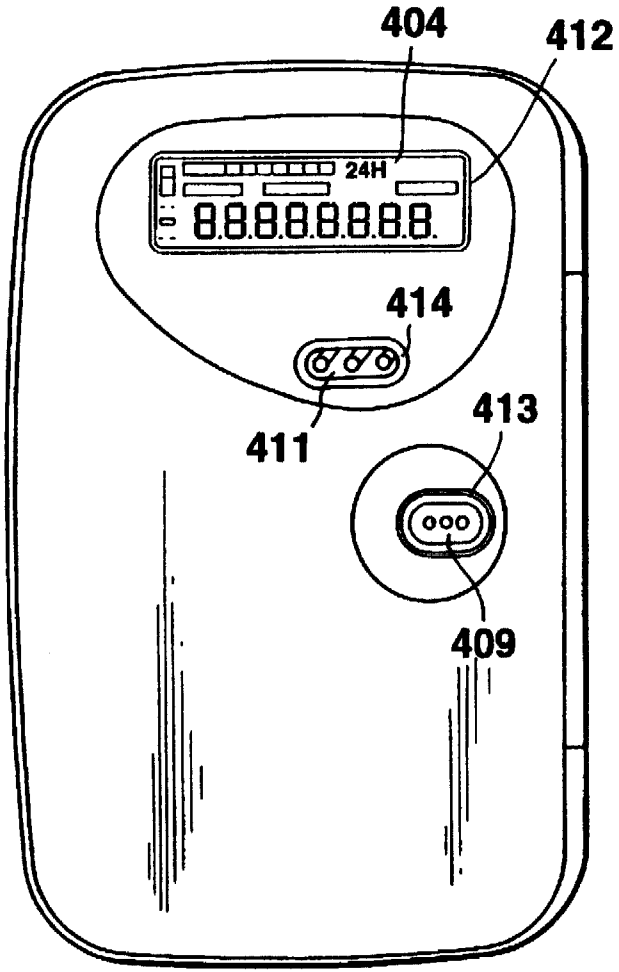
FIG. 10A is a front view of the alarm device of FIG. 9 with its hanging member fit into the body.
Figure 11:
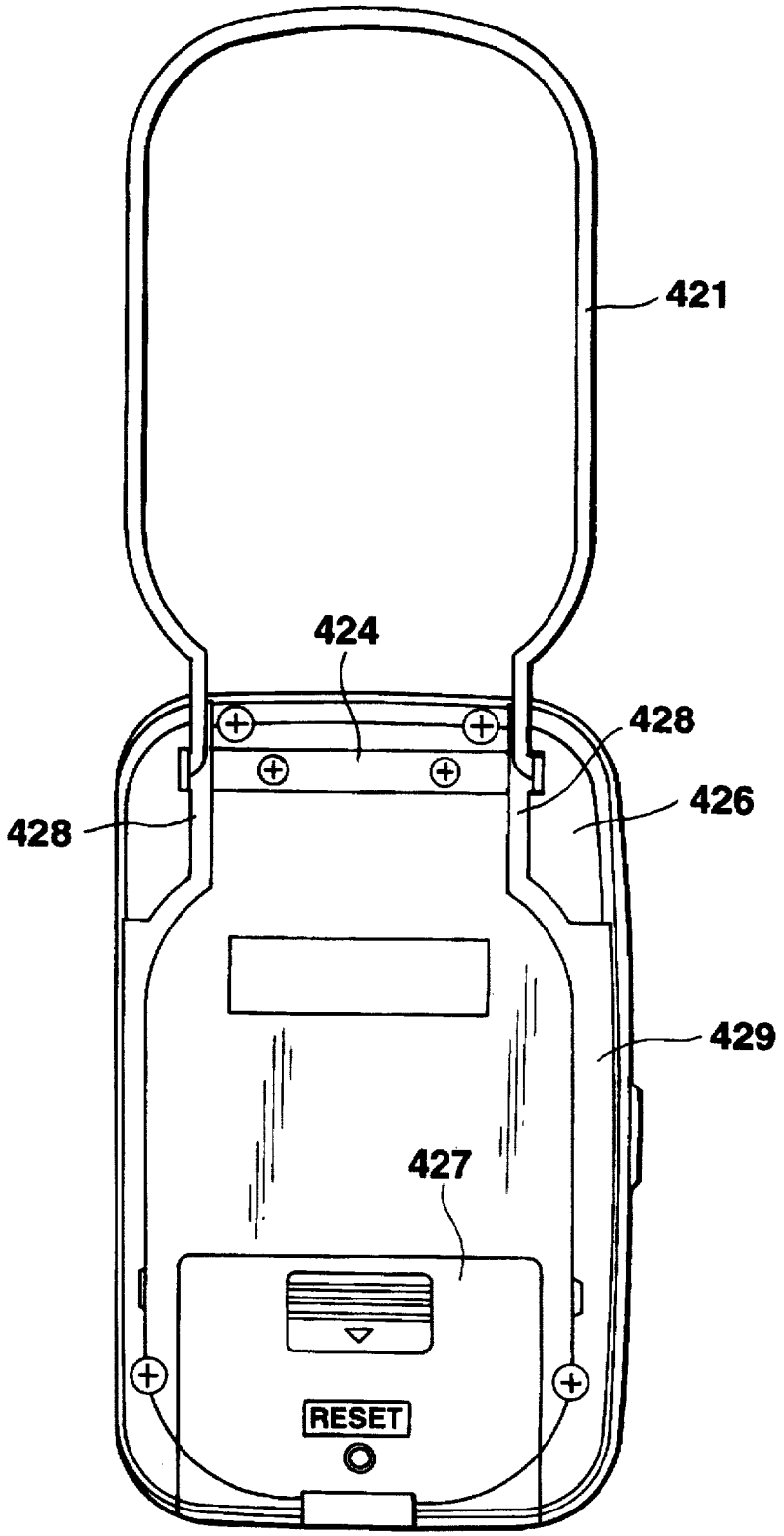
FIG. 11 is a view similar to that of FIG. 10C and illustrates the hanging member in its erected position.

FIGS. 10A, 10B and 10C are exterior views of the alarm device 401 with a hanging member 421, which is adapted to hang the alarm device 401 on a doorknob, fit into the alarm device body and the cover 402 closed. Specifically, FIG. 10A is a front view, FIG. 10B is a right side view, and FIG. 10C is a rear view. FIG. 11 shows the rear exterior of the alarm device with its hanging member 421 erected.

As shown in FIG. 10A, even when the cover 402 is closed, the display contents of the display section 404 can be viewed through the display window 412 and an alarm sound of the buzzer 411 is transmitted through the opening 414. Further, the alarm sound emitting key 409 can be operated from the outside through the key exposing opening 413.

As shown in FIG. 10C, the alarm device hanging member 421 made of a stainless round bar is fixed by hooks 422 to the rear side of the body of the alarm device, so that it is fit into the body of the alarm device.

That is, the lower case 426 is formed with a recess 429 into which the hanging member 421 is fit so that it will not protrude from the surface of the lower case and the hooks 422 for fixing the hanging member 421 when it is fit into the recess 429. The lower case 426 is also formed with grooves 428, into which straight portions of the hanging member 421 in the vicinity of its pivots are inserted when the hanging member 421 is erected, in such a way as to communicate with the recess 429.

The hanging member 421 is rotatably inserted at its ends into holes (not shown) of joint metal fixtures 423. Thus, the hanging member 421 can be fit into the body of the alarm device 401 or can be erected so that it is hung on a doorknob. After the insertion of the hanging member 421 into the joint fixtures 423, a fixing member 424 is fixed to the lower case 426 by screws **425*a* and 425*b*, whereby the hanging member is prevented from coming off the joint fixtures 428**.

When fit into the body of the alarm device 401, the hanging member 421 is brought into contact (engagement) with the end of a battery cover 427 which covers a battery container not shown. For battery replacement, the battery cover 427 can be removed from the body of the alarm device 401 by sliding it downward in FIG. 10C.

Therefore, with the hanging member 421 fit into the body 401, the battery cover 427 is prevented from sliding by the hanging member 421. This prevents the battery cover 427 from coming off with vibrations applied when the alarm device is carried.

As shown in FIG. 11, by erecting the hanging member 421 and inserting its straight portions into the grooves 428 of the lower case 426, the hanging member 421 can be fixed erected by 180 degrees from the body of the alarm device 401. With the hanging member 421 hung on a doorknob, the doorknob alarm ON key 406, the sensitivity adjustment volume 415 and the like can be operated to set the doorknob alarm feature to the ON state.

Figure 12A:
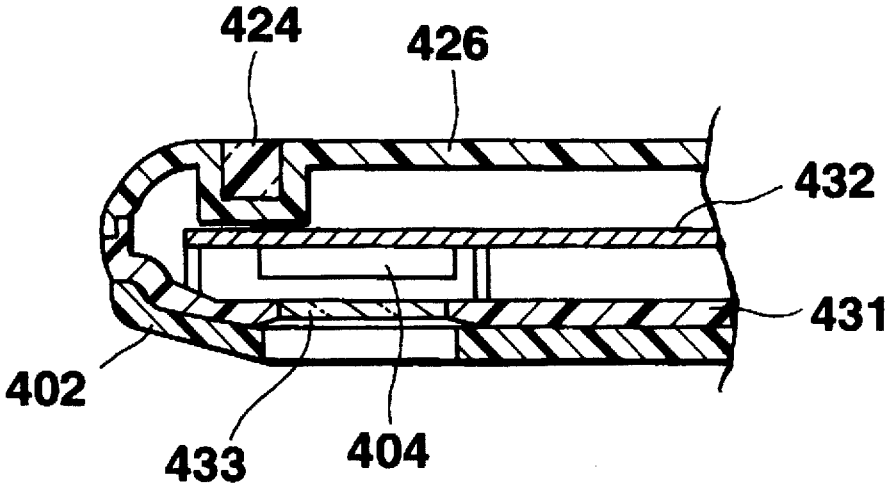
FIG. 12A is a sectional view taken along line 12A—12A of FIG. 10C.
Figure 12B:
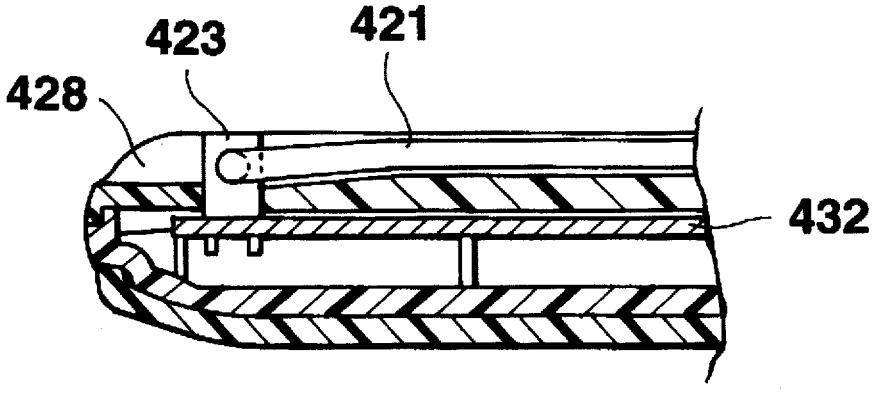
FIG. 12B is a sectional view taken along line 12B—12B of FIG. 10C.

FIG. 12A is a sectional view taken along line A–A' of FIG. 10C and FIG. 12B is a sectional view taken along line B–B' of FIG. 10C.

As shown in FIG. 12A, the case 403 of the alarm device 401 comprises lower and upper cases 426 and 431, which are coupled together by screws. To the upper case 431 is attached a circuit board 432 on which the liquid crystal display 404, a CPU, human body detecting circuitry and the like are mounted. A glass plate 433 is provided in that portion of the upper case 431 which corresponds to the display 404, which can thus be viewed through the glass plate 433 and the display window 412 from the outside of the cover 402.

As shown in FIG. 12B, the joint fixtures 423, which support the hanging member 421 rotatably, are fixed to the circuit board 432 by means of soldering.

Figure 13:
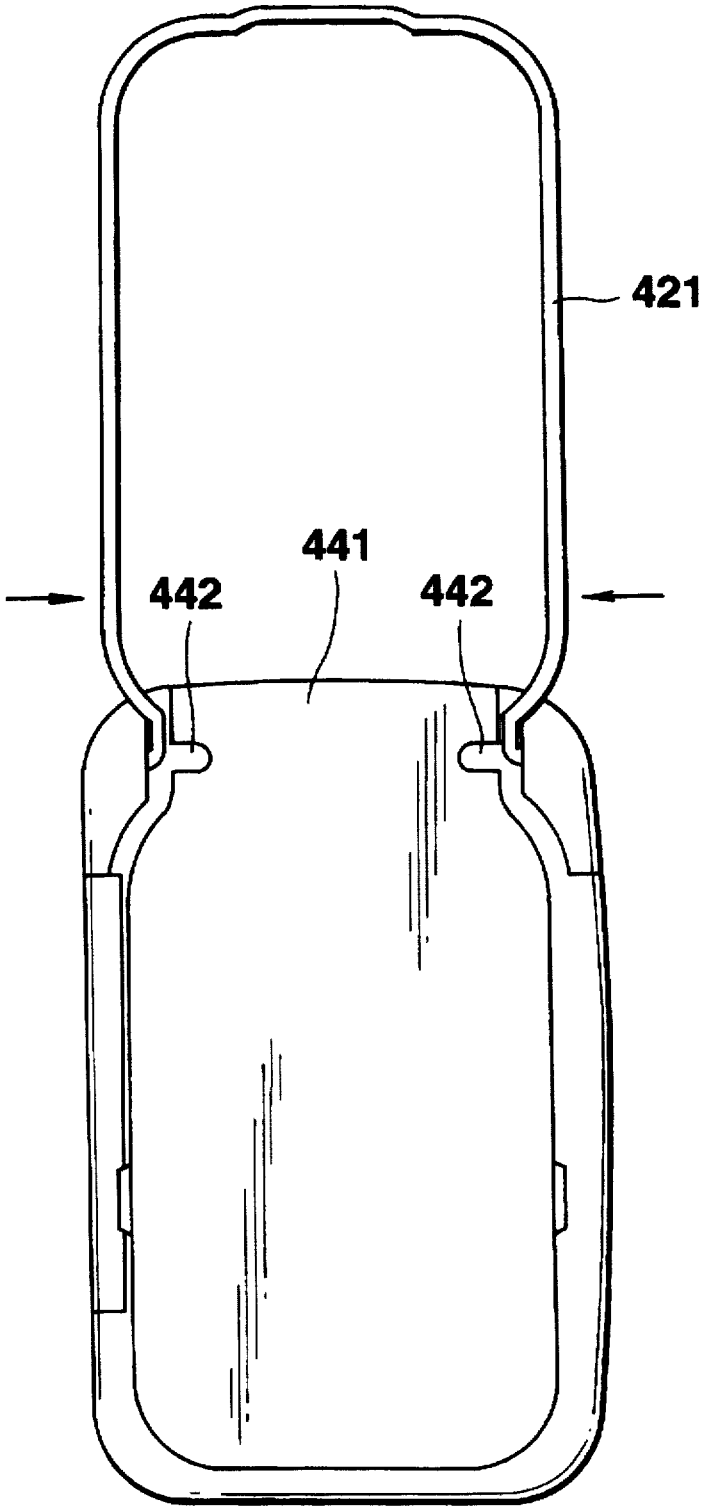
FIG. 13 shows a modification of the second embodiment.

FIG. 13 shows a modification of the second embodiment in which the hanging member 421 is removably mounted to the body of the alarm device 401.

FIG. 13 shows the rear side of the alarm device 401 with the hanging member 421 erected. The lower case 441 is formed with grooves 442 in the position where the hanging member 421 is mounted. Thereby, the hanging member 421 can be removed from the joint fixtures 423 when it is rotated through 90 degrees with respect to the rear side of the body 401. That is, to remove the hanging member 421 from the joint fixtures 423, the user simply applies force to the hanging member 421 in the directions of arrows with the hanging member 421 rotated through 90 degrees as shown in FIG. 13.

Normally, that portion of a doorknob which is attached to a door is smaller in diameter than the knob itself. The doorknob alarm device of FIG. 13 is specially adapted to the case where the diameter of a knob is greater than the internal diameter of the hanging member 421. In such a case, the user removes the hanging member 421 from the joint fixtures 423 and then hangs only the hanging member 421 on the smaller-diameter portion of the doorknob. After that, the user inserts the hanging member 421 into the joint fixtures 423 again and then rotates the hanging member 421 through 90 degrees, thereby permitting the body of the alarm device to hang on the doorknob.

Figure 14:
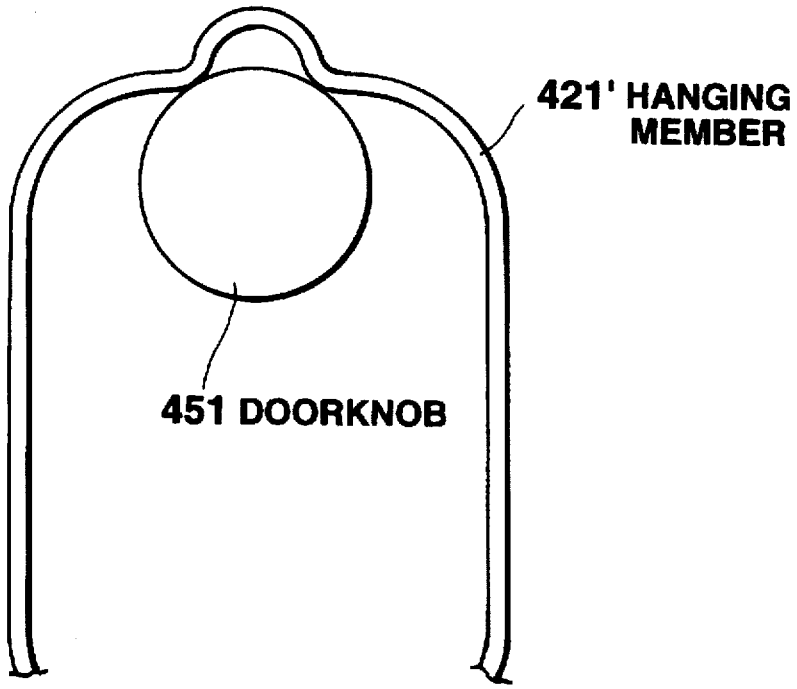
FIG. 14 shows the other modification of the second embodiment.

FIG. 14 shows another modification of the second embodiment in which the hanging member 421' is so shaped that it comes in contact with a doorknob at two points.

The hanging member 421' is formed with a convex portion in its portion that contacts a doorknob 451. Whereas the hanging member 421 of FIG. 13 contacts a doorknob at one point, the hanging member 421' of FIG. 14 contacts a doorknob at two points, thus permitting the alarm device 401 to hang on the doorknob more stably.

The alarm device 401 is adapted to detect not only human bodies contacting or approaching a doorknob but also vibrations of the doorknob. When the alarm device is hung on a doorknob in an unstable manner, it may swing by wind pressure as caused when a person goes by and malfunction.

The modification of FIG. 14, which will hang the small-sized alarm device 401 on a doorknob in a stabler manner than with the prior art, permits the possibility of malfunction to be reduced. Of course, the hanging member 421' may be so shaped that it contacts a doorknob at more than two points.

According to the second embodiment, the hanging member of the small-sized alarm device can be fit into the body of the alarm device, providing a significant improvement in portability. In addition, by removably mounting the hanging member to the body of the alarm device, it becomes possible to hang the alarm device on doorknobs of various shapes.

(3) Third Embodiment

Hereinafter, a third embodiment of the present invention will be described with reference to FIGS. 15 through 25.

A small-sized alarm device of the third embodiment is identical in appearance to the small-sized alarm device of the second embodiment and its description is thus omitted. As with the first and second embodiments, the alarm device of the third embodiment has a calculator mode, a timekeeping mode, and an alarm mode and is equipped with an electro-optic display for displaying data in each mode. Doorknob alarm device related information is also displayed on the electro-optic display.

Figure 15:
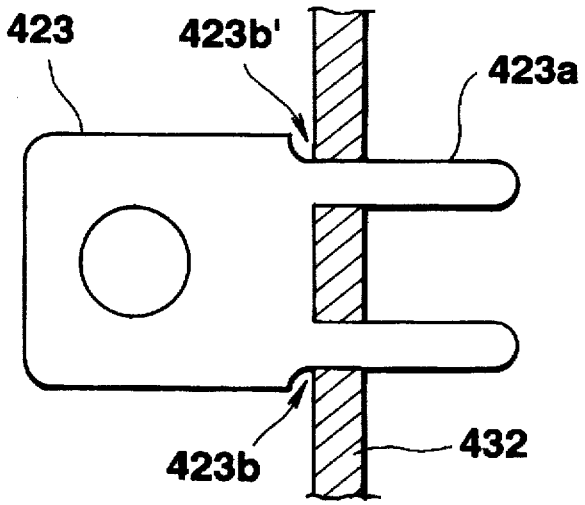
FIG. 15 shows a state where a joint metal fitting is mounted on a printed board in a small-sized alarm device according to a third embodiment of the present invention.

FIG. 15 shows the state where the joint fixture 423 for rotatably supporting the hanging member 421 is fixed to the circuit board 432. As shown, the joint fixture 423 is fixed with its legs inserted into holes in the circuit board 432. At this point, grooves **423*b* and 423*b*' adapted to insert a coupling member 522 to be described later are formed between the lower end of the joint fixture 423 and the circuit board 432**.

Figure 16:
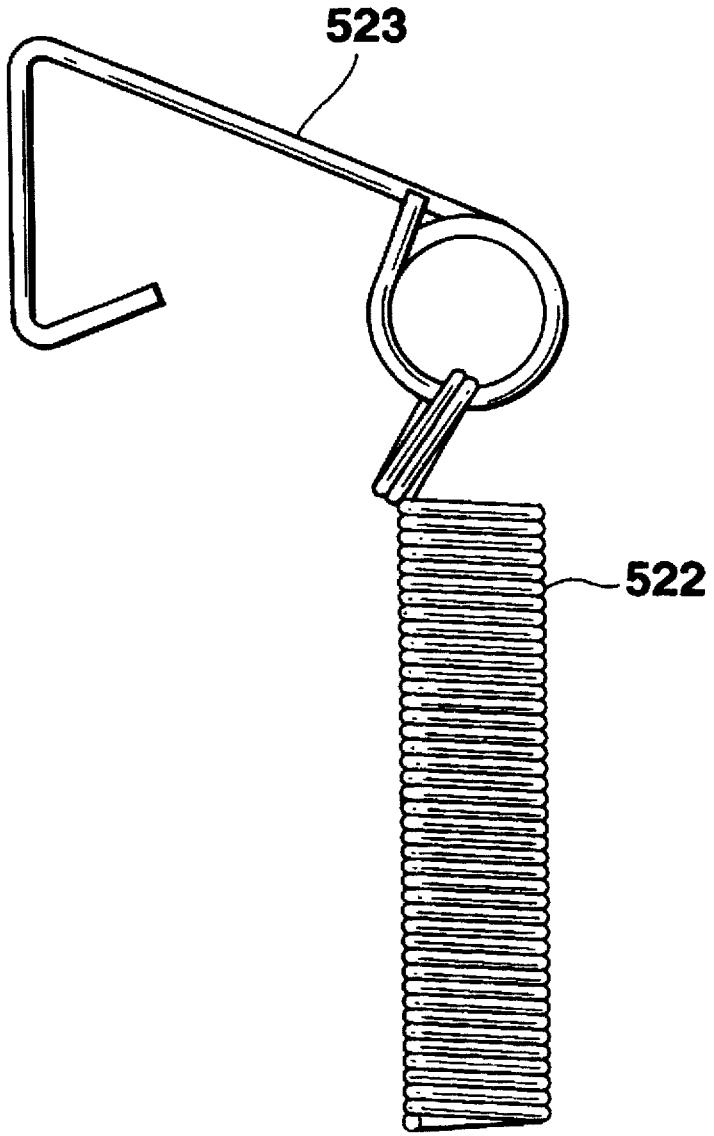
FIG. 16 shows a coupling member and a coil.

FIG. 16 shows the state where an electrically conductive coil 522 adapted to detect vibrations is swingably attached to the coupling member 523. The coupling member 523, made of an electrically conductive elastic material, has its one end formed substantially in the shape of the numeric character 7 and its other end formed in the shape of a ring. Likewise, the coil 522 has its one end formed in a ring. The ring portion of the coil 522 is inserted into the ring portion of the coupling member 523, whereby they are coupled with each other.

Figure 17C:
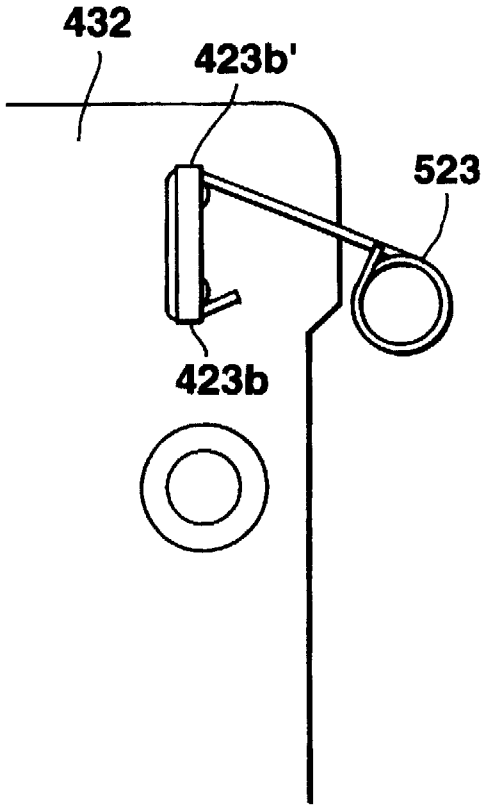
FIGS. 17A, 17B and 17C show the procedure of mounting the coupling member on the printed board.
Figure 17B:
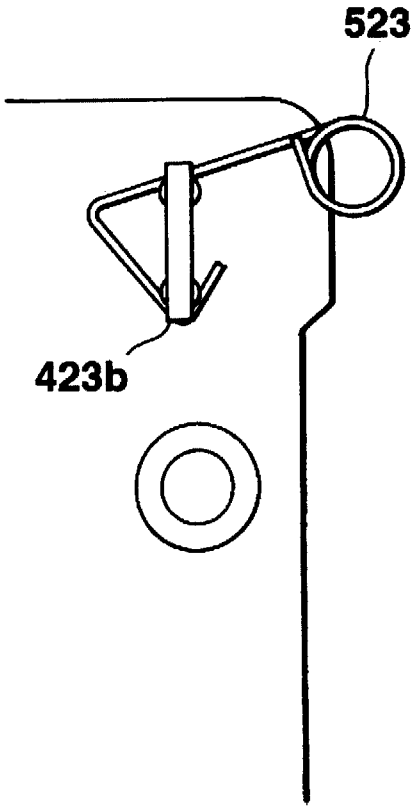

Here, the working procedure of fixing the coupling member 523 to the joint fixture 423 with the fixture 423 fixed to the circuit board 432 will be described with reference to FIGS. 17A, 17B and 17C.

Figure 17A:
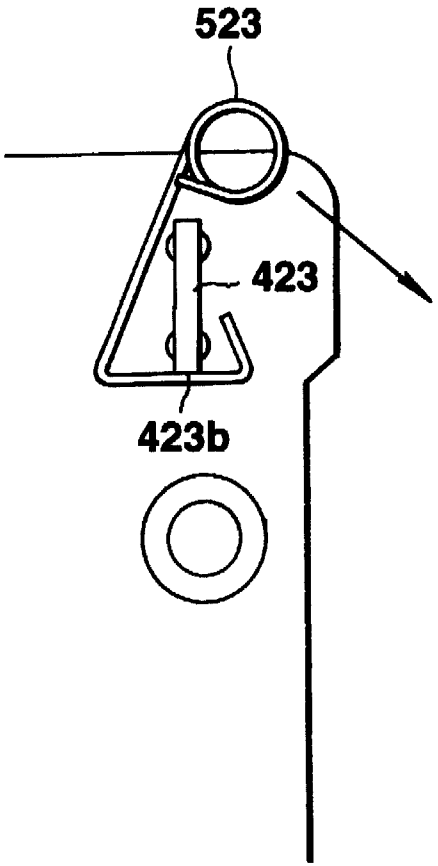

First, as shown in FIG. 17A, the upper portion of the 7-shaped portion of the coupling member 523 is brought into contact with the groove **423*b* on the lower side of the joint fixture 423 and then the coupling member 523 is rotated clockwise. Then, as shown in FIG. 17B, with a bend portion of the 7-shaped portion of the coupling member 523 engaged with the lower groove 423*b* between the fixture 423 and the circuit board 432, the coupling member 523 is further rotated clockwise. Finally, as shown in FIG. 17C, the other bend portion of the 7-shaped portion of the coupling member 523 is inserted into the upper groove 423b' between the joint fixture 423 and the circuit board 432, thereby fixing the coupling member 523 to the circuit board 432**.

Figure 18B:
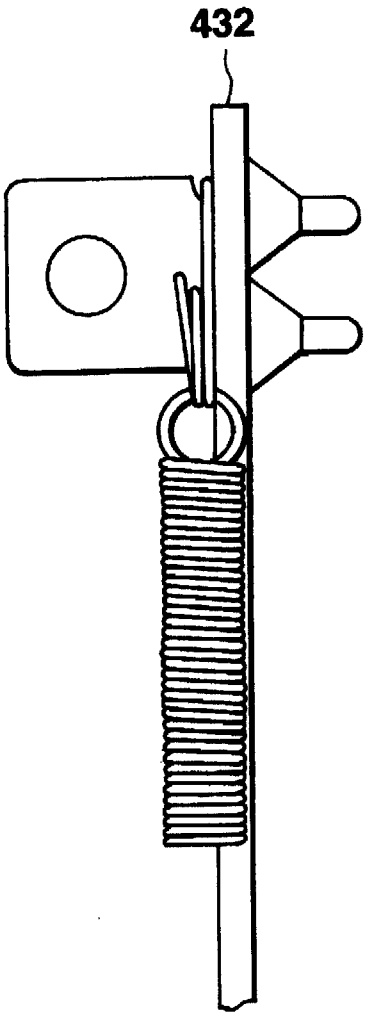
FIGS. 18A and 18B show the coupling member and the printed board soldered together.
Figure 18A:
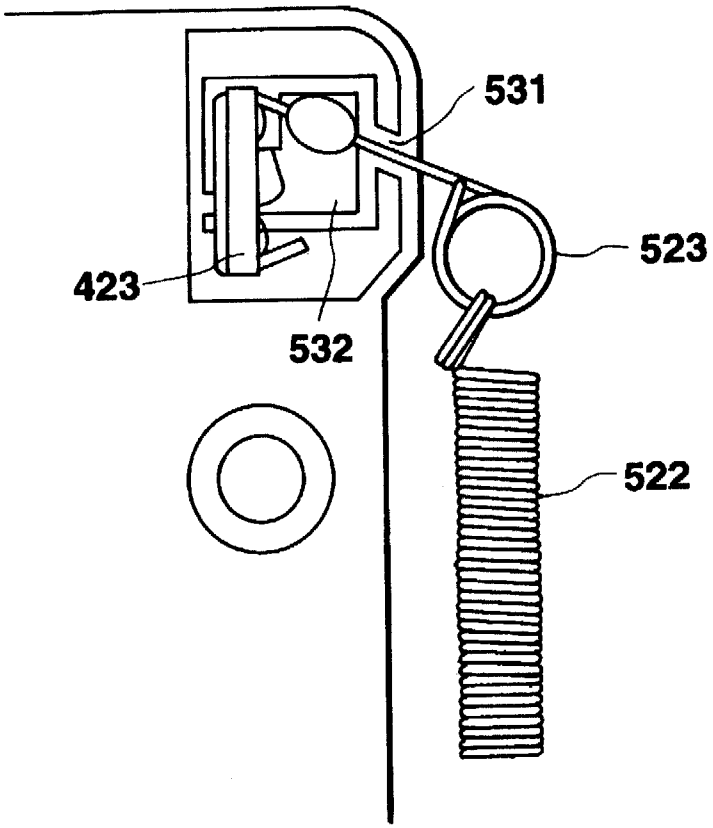

After the coupling member 523 is temporarily fixed to the circuit board 432 with the member 523 inserted into the grooves 423b and 423b', the ring portion of the coupling member 523 and the ring portion of the coil 522 are coupled together as shown in FIGS. 18A and 18B. Thus, the coil 522 is coupled with the coupling member 523 swingably.

In the vicinity of the position in which the joint fixture 423 is mounted to the circuit board 432, the circuit board 432 is formed with a notch 531 for positioning, which is used in fixing the 7-shaped portion of the coupling member 523 to the joint fixture 423, as shown in FIG. 18A. By positioning the coupling member 523 along the notch 531, the coupling member 523 can be soldered to the desired place on the circuit board 432.

Figure 19:
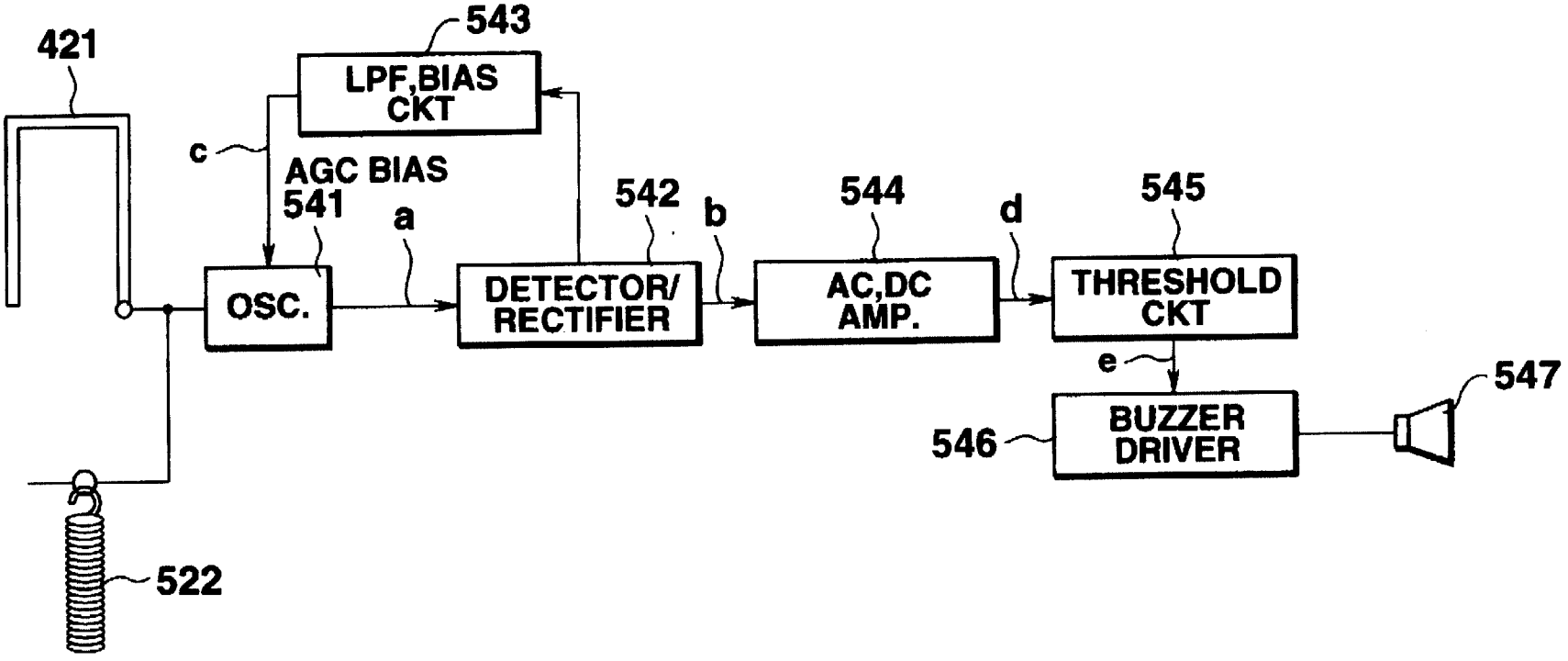
FIG. 19 is a circuit block diagram of the contact and vibration detecting circuitry in the third embodiment of the present invention.

Next, the contact and vibration detecting circuitry of the alarm device 501 of the third embodiment will be described with reference to FIG. 19.

An oscillator 541 produces a high-frequency signal of a predetermined frequency and provides it to the hanging member 421, the coil 522, and a detector/rectifier 542. When no human body contacts the hanging member 421, the amplitude of high-frequency signal output from the oscillator 541 is great. When a human body contacts or approaches the doorknob, the high-frequency signal amplitude becomes small or the oscillation itself stops. When the coil 522 vibrates as in the case where external force is applied to the door, the oscillator 541 will produce an output signal whose amplitude varies with time.

The detector/rectifier 542 envelope-detects/rectifies the output signal of the oscillator 541 and feeds its output to an AC/DC amplifier 544. A bias circuit 543 is a feedback circuit for stabilizing the oscillation level of the oscillator 541 and includes a lowpass filter.

The AC/DC amplifier 544 is an amplifier which amplifies an alternating-current signal and a direct-current signal and sends its output to a threshold circuit 545, which makes a decision as to whether or not the output signal level of the AC/DC amplifier 544 is above a predetermined threshold level. When the threshold level is exceeded, the threshold circuit 545 directs a buzzer driver 546 to sound a buzzer 547.

Figure 20:
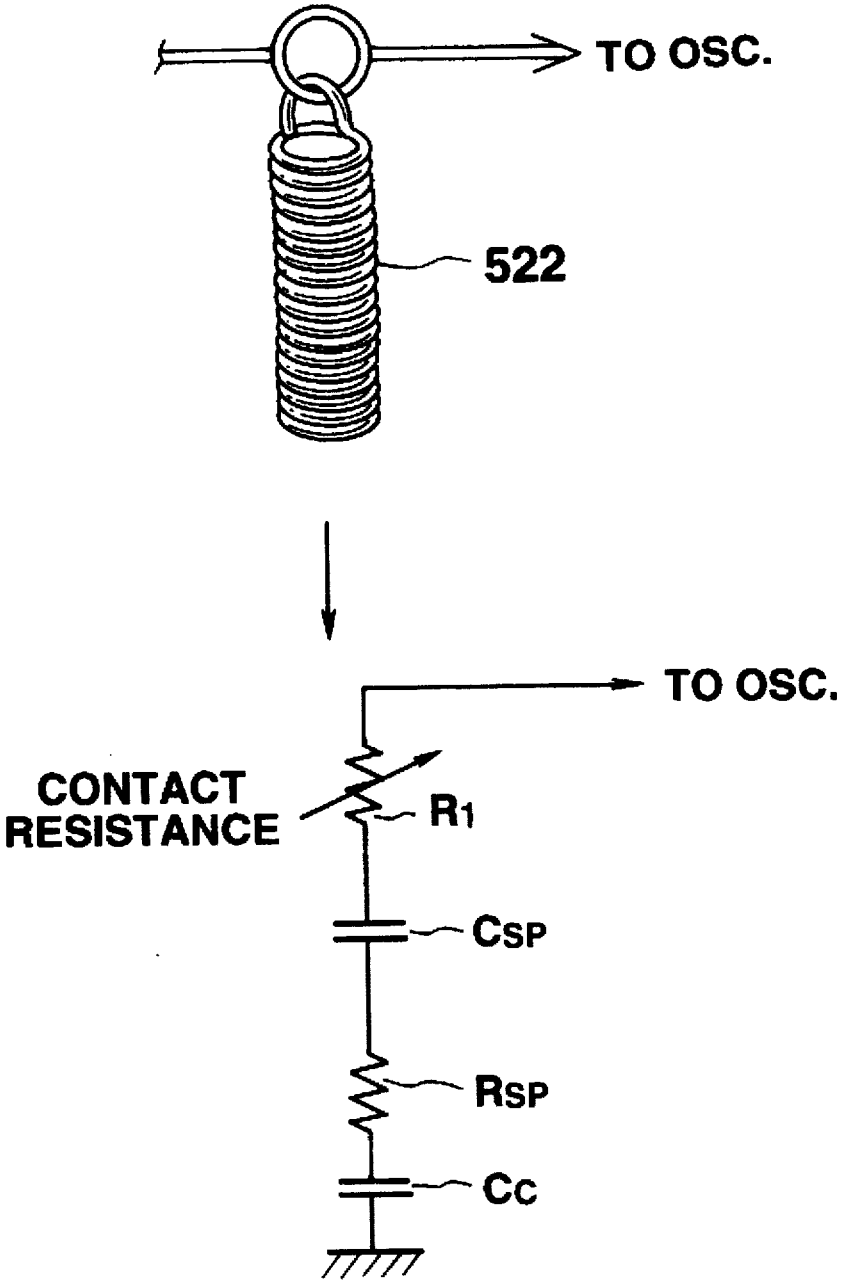
FIG. 20 shows an equivalent circuit of a coil.

At this point, an equivalent circuit of the coil 522 will be described with reference to FIG. 20. The impedance of the coil 522 can be represented by the contact resistance R1 between the coil 522 and the coupling member 523, the capacitance Csp and resistance Rsp of the coil 522, and the capacitance Cc between the coil 522 and ground. The coil capacitance Csp and resistance Rsp varies with vibrations of the coil 522. Thus, whether the coil 522 is vibrating or not can be detected by detecting variations in the coil impedance.

Next, the operation of the circuitry of FIG. 19 will be described with reference to FIGS. 21 through 25, each of which illustrates signal waveforms in three states: the normal state where the hanging member 421 and the coil 522 undergo no impedance variation, i.e., no human body is detected; the load state where the contact or approach of a human body is detected; and the vibration state where door vibration is detected.

Figure 21A:
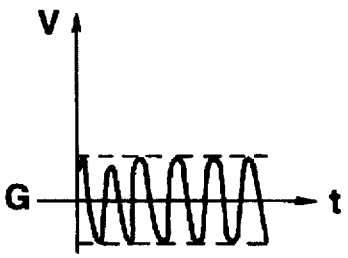
FIGS. 21A, 21B and 21C show output signals of the oscillator of FIG. 19 in three different states.
Figure 21B:
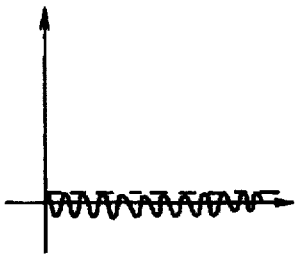
Figure 21C:
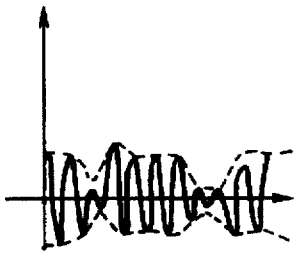

The output waveform "a" of the oscillator 541 has a substantially constant amplitude as in FIG. 21A in the normal state, has a decreased amplitude as in FIG. 21B in the load state, and has an amplitude which varies with varying impedance of the coil 522 due to vibrations as in FIG. 21C in the vibration state.

Figure 22A:
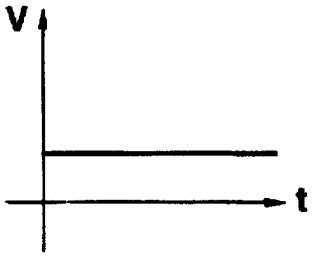
FIGS. 22A, 22B and 22C show output signals of the detector/rectifier of FIG. 19 in the three states.
Figure 22B:
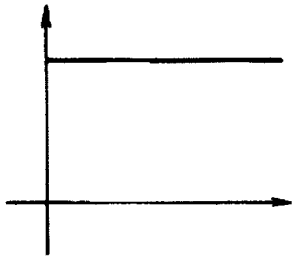
Figure 22C:
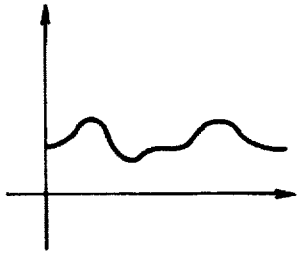

The output signal "b" of the detector/rectifier 542, which is obtained by inverting a signal resulting from envelop detection of the output signal of the oscillator 541, has a direct-current waveform at a low level as in FIG. 22A in the normal state, a direct-current waveform at a high level as in FIG. 22B in the load state, and a pulsating current waveform as in FIG. 22C in the vibration state.

Figure 23A:
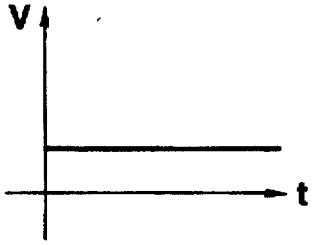
FIGS. 23A, 23B and 23C show output signals of the bias circuit of FIG. 19 in the three states.
Figure 23B:
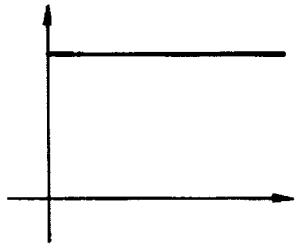
Figure 23C:
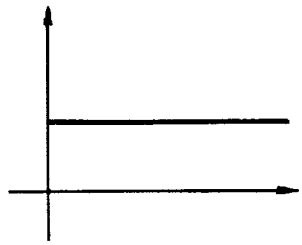

The output signal "c" of the bias circuit 543, which outputs a signal corresponding to the output signal level of the oscillator 541, has a direct-current waveform at a low level as in FIG. 23A in the normal state, a direct-current waveform at a high level as in FIG. 23B in the load state, and a direct-waveform at the average level of the output amplitude of the oscillator as in FIG. 23C in the vibration state.

Figure 24A:
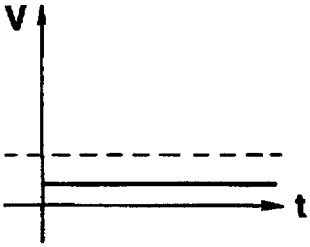
FIGS. 24A, 24B and 24C show output signals of the AC/DC amplifier of FIG. 19 in the three states.
Figure 24B:
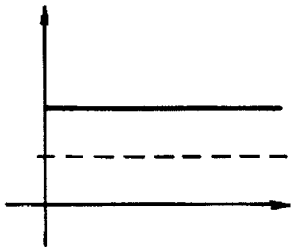
Figure 24C:
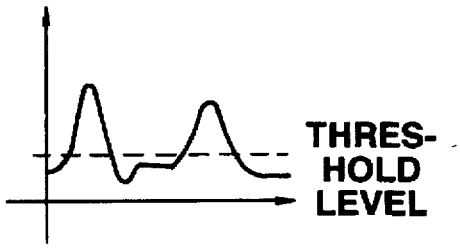

The output signal "d" of the AC/DC amplifier 544, which is obtained by amplifying the output signal "b" of the detector/rectifier 542, has a direct-current waveform at a level lower than the threshold level as in FIG. 24A in the normal state, a direct-current waveform at a higher level than the threshold level as in FIG. 24B in the load state, and a pulsating-current waveform which fluctuates above and below the threshold level as in FIG. 24C in the vibration state.

Figure 25A:
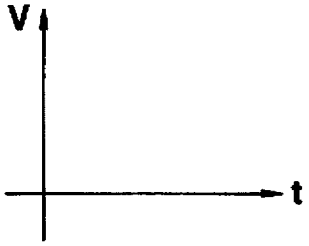
FIGS. 25A, 25B and 25C show output signals of the threshold circuit of FIG. 19 in the three states.
Figure 25B:
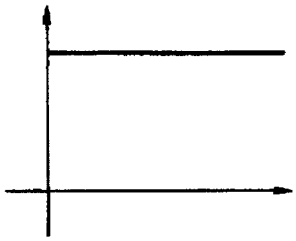
Figure 25C:
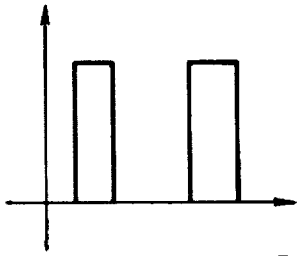

As a result, the output signal e of the threshold circuit 545 is at a low level as in FIG. 25A in the normal state, at a high level as in FIG. 25B in the load state, and alternates between the high level and the low level as in FIG. 25C in the vibration mode.

At this time, the operation of the circuitry of FIG. 19 when the contact with or approach to the doorknob of a human body is detected (the load state) and the vibrations of the door is detected (the vibration state) will be described.

First, a description will be given of the operation in the load state. When a human body contacts or approaches the doorknob, the impedance of the hanging member 421 on the doorknob varies, decreasing the amplitude of the output signal "a" of the oscillator 541 (see FIG. 21B).

The output signal "a" of the oscillator 541 undergoes envelope detection and a DC signal at a high level, which is the inverse of the envelope-detected output, is output to the DC/AC amplifier 544 as the output signal "b" of the detector/rectifier 542 (see FIG. 22B).

The DC signal is amplified in the AC/DC amplifier 544 and then compared with the threshold level of the threshold circuit 545. If the amplified DC signal level is above the threshold level (FIG. 24B), then the buzzer 547 emits an alarm sound.

Next, the operation in the vibration state will be described. When external force is applied to the door, the built-in coil 522 of the alarm device 501 vibrates, varying its impedance.

As a result, the output signal "a" of the oscillator 541 becomes an AC signal the amplitude of which varies with variations in the coil impedance due to vibrations. The output signal "a" of the oscillator undergoes envelope detection in the detector/rectifier 542 and then output to the AC/DC amplifier 544 as a pulsating-current signal (FIG. 22B).

The pulsating-current signal is amplified in the AC/DC amplifier 544 and then compared with the threshold level of the threshold circuit 545. If the threshold level is exceeded (FIG. 24C), then the buzzer 547 emits an alarm sound.

According to the third embodiment, whether the coil 523 is vibrating, that is, whether the door is vibrating can be detected by coupling the ring portion of the coil 523 with the ring portion of the coupling member 523 and detecting variations in the impedance of the coil. Thus, it becomes possible to detect whether or not a suspicious person is contacting the door with a simple construction.

Although, in the embodiment, the coupling member is formed in the shape of the numeric character 7, it may be formed in any other shape. For example, when the coupling member 523 is directly soldered to the circuit board 423, it is necessary that the member 523 has only a ring portion that permits the coil 522 to swing.

According to the third embodiment, whether or not the coil is vibrating, that is, whether or not the door on which the alarm body is hung is vibrating can be judged by detecting variations in the coil impedance. Even if the doorknob is not made of an electrically conductive material, therefore, an alarm sound can be produced when a suspicious person vibrates the door to enter the room.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A small-sized alarm device comprising:

a case;

a substantially U-shaped hanging member, two ends of the U-shaped hanging member being rotatably mounted to said case, the hanging member having an opening which is to be hanged on a doorknob; and an alarm, installed in said case, for emitting an alarm sound upon detecting, via said hanging member, that a human body contacts or approaches said doorknob, said case comprising a fitting section into which said hanging member is fit, the fitting section provided in a given surface of said case, said hanging member being fitted into said fitting section so that the hanging member aligns with the given surface when the alarm device is carried and being rotated by about 180° around the two ends so that the opening is erected from said case in order to hang on said doorknob, the length of said hanging member being not longer than the length of said case.

2. The alarm device according to claim 1, wherein said case comprises a battery container covered with a movable battery cover, said battery cover being prevented by said hanging member from moving when said hanging member is fit into said fitting section of said case.

3. The alarm device according to claim 1, wherein said case comprises hooks for fixing said hanging member when said hanging member is fit into said fitting section.

4. The alarm device according to claim 1, wherein said case comprises a slit into which a part of said hanging member is inserted when it is erected from said case to thereby control the position of said hanging member.

5. The alarm device according to claim 1, further comprising a electro-optic display for displaying information relating to said alarm.

6. The alarm device according to claim 1, in which said case comprises:

a keyboard for inputting data; and a display for displaying the data input by said keyboard.

7. The alarm device according to claim 6, in which said display is provided at a surface opposite to the given surface of said case.

8. A small-sized alarm device comprising:

a case;

an electrically conductive hanging member for hanging said case on a doorknob;

an electrically conductive coil electrically connected to said hanging member;

an alarm, installed in said case, for emitting an alarm sound upon detecting contact or approach of a human body, the alarm comprising:

an oscillator circuit electrically connected to said hanging member and said coil, said oscillator circuit varying its output when a human body contacts or approaches said doorknob or said coil vibrates;

a detector for detecting, via said hanging member, contact with or approach to said doorknob by a human body or the vibration of a door due to contact with said door by a human body in response to an output of said oscillator circuit; and an alarm sound emitter for emitting an alarm sound when said detector detects that a human body is contacting or approaching said doorknob or the door is vibrating;

a data processor, installed in said case, for processing data; and an electro-optic display, mounted on said case, for displaying said data processed by said data processor and information relating to the operation of said alarm.

9. The alarm device according to claim 8, wherein said data processor comprises timekeeping device for obtaining current time data, which is displayed on said electro-optic display.

10. The alarm device according to claim 8, wherein said data processor comprises a currency converter for converting an amount of money in the currency of a first country into an amount of money in the currency of a second country, converted money data being displayed on said electro-optic display.

11. The alarm device according to claim 8, wherein said alarm comprises a switch for starting or stopping the operation of said alarm, and said information relating to the operation of said alarm is information as to whether said alarm is in operation or not.

12. The alarm device according to claim 8, wherein said alarm comprises a switch for starting the operation of said alarm, controller for starting the operation of said alarm after a lapse of a predetermined period of time from the operation of said switch, and counter for counting the remainder of the time from the operation of said switch to the start of the operation of said alarm, and said information relating to the operation of said alarm is information about the remainder of the time.

13. The alarm device according to claim 8, wherein said alarm comprises a sound volume setting device for setting the volume of said alarm sound, and said information relating to the operation of said alarm is the volume of said alarm sound set by said sound volume setting device.

14. The alarm device according to claim 8, wherein said alarm comprises a controller for, when the contact or approach of a human body is detected, causing a warning sound to be emitted for a predetermined period of time and then causing an alarm sound greater in volume than said warning sound to be emitted.

15. The alarm device according to claim 8, wherein said case comprises a body on which said electro-optic display is mounted and a cover openably mounted to said body, said cover being formed with a window for exposing said electro-optic display.

16. The alarm device according to claim 8, wherein said data processor comprises a keyboard with a numeric keypad for entering numeric data and arithmetic function keys for entering arithmetic functions, and calculation means for performing calculations based on numeric data and arithmetic functions entered from said keyboard, the result of the calculations being displayed on said electro-optic display.

17. The alarm device according to claim 16, wherein said case comprises a body on which said electro-optic display and said keyboard are mounted and a cover openably mounted to said body, said cover covering said keyboard when closed and being formed with a windows for exposing said electro-optic display when closed.

18. The alarm device according to claim 8, further comprising a hanging member for hanging said case on a doorknob, said hanging member being rotatably mounted to said case, and wherein said case comprises a fitting section into which said hanging member is fit, said hanging member being erected in order to hang on said doorknob and fit into said fitting section of said case when not in use.

19. The alarm device according to claim 18, wherein said case comprises a battery container covered with a movable battery cover, said battery cover being prevented by said hanging member from moving when said hanging member is fit into said fitting section of said case.

20. A small-sized alarm device comprising:

a case;

a keyboard mounted on said case and having a numeric keypad for entering numeric data and arithmetic function keys for entering arithmetic functions;

a calculator, installed in said case, for performing calculations based on numeric data and arithmetic functions entered from said keyboard;

a display, mounted on said case, for displaying the results of calculations performed by said calculator;

an electrically conductive hanging member for hanging said case on a doorknob;

an electrically conductive coil electrically connected to said hanging member;

an oscillator circuit installed in said case and electrically connected to said hanging member and said coil, said oscillator circuit varying its output when a human body contacts or approaches said doorknob or said coil vibrates;

a detector, installed in said case, for detecting, via said hanging member, contact with or approach to said doorknob by a human body or the vibration of a door due to contact with said door by a human body in response to an output of said oscillator circuit; and an alarm sound emitter, installed in said case, for emitting an alarm sound when said detector detects that a human body is contacting or approaching said doorknob or the door is vibrating.

21. The alarm device according to claim 20, further comprising a hanging member for hanging said case on a doorknob, said hanging member being rotatably mounted to said case, and wherein said case comprises a depressed portion into which said hanging member is fit, said hanging member being erected in order to hang on said doorknob and fit into said depressed portion of said case when not in use.

22. The alarm device according to claim 20, further comprising a display controller for causing said display to display information relating to the operation of said alarm.

23. The alarm device according to claim 20, wherein said case comprises an openable cover which covers said keyboard when closed, said cover being formed with a window for exposing said display when closed.

24. A small-sized alarm device comprising:

a case;

an electrically conductive hanging member for hanging said case on a doorknob;

an electrically conductive coil electrically connected to said hanging member;

an oscillator circuit installed in said case and electrically connected to said hanging member and said coil, said oscillator circuit varying its output when a human body contacts or approaches said doorknob or said coil vibrates;

a detector, installed in said case, for detecting, via said hanging member, contact with or approach to said doorknob by a human body or the vibration of a door due to contact with said door by a human body in response to an output of said oscillator circuit; and a alarm sound emitter, installed in said case, for emitting an alarm sound when said detecting detects that a human body is contacting or approaching said doorknob or the door is vibrating.

25. The alarm device according to claim 24, wherein said detector detects whether the human body is contacting or approaching said doorknob or whether the door is vibrating from variations in the amplitude of an output signal of said oscillator.

26. The alarm device according to claim 24, wherein said coil has one end fixed and the other end made swingable.

27. The alarm device according to claim 24, wherein said coil is installed in said case.

28. The alarm device according to claim 24, further comprising an electro-optic display for displaying information relating to the operation of said alarm sound emitter.

* * * * *